US006762357B2

(12) United States Patent
Washiyama et al.

(10) Patent No.: US 6,762,357 B2
(45) Date of Patent: Jul. 13, 2004

(54) RESONANCE APPARATUS, RESONANCE METHOD AND COMPUTER PROGRAM FOR RESONANCE PROCESSING

(75) Inventors: Yutaka Washiyama, Hamamatsu (JP); Seiji Okamoto, Hamamatsu (JP)

(73) Assignee: Kawai Musical Instruments Mfg. Co., Ltd., Shizuoka-ken (JP)

( * ) Notice: Subject to any disclaimer, the term of this patent is extended or adjusted under 35 U.S.C. 154(b) by 56 days.

(21) Appl. No.: 10/123,118

(22) Filed: Apr. 17, 2002

(65) Prior Publication Data

US 2002/0166441 A1 Nov. 14, 2002

(30) Foreign Application Priority Data

Apr. 17, 2001 (JP) ..... 2001-118198

(51) Int. Cl.[7] ..... G10H 1/06; G10H 7/00
(52) U.S. Cl. ..... 84/603; 84/622; 84/721
(58) Field of Search ..... 84/603, 622, 721, 84/746

(56) References Cited

U.S. PATENT DOCUMENTS

| | | | | |
|---|---|---|---|---|
| 5,095,800 A | | 3/1992 | Matsuda | |
| 5,107,747 A | | 4/1992 | Saito | |
| 5,648,629 A | * | 7/1997 | Kozuki | 84/660 |
| 5,739,454 A | * | 4/1998 | Kunimoto | 84/615 |
| RE35,813 E | * | 6/1998 | Usa et al. | 84/606 |
| 6,180,866 B1 | * | 1/2001 | Kitamura | 84/630 |

FOREIGN PATENT DOCUMENTS

| | | |
|---|---|---|
| JP | 2-220098 A | 9/1990 |
| JP | 3-164796 A | 7/1991 |
| JP | 3-171197 A | 7/1991 |
| JP | 4-93999 A | 3/1992 |
| JP | 4-233595 A | 8/1992 |
| JP | 4-233596 A | 8/1992 |
| JP | 4-298790 A | 10/1992 |
| JP | 8-106291 A | 4/1996 |
| JP | 8-111856 A | 4/1996 |
| JP | 8-137469 A | 5/1996 |
| JP | 8-137470 A | 5/1996 |
| JP | 8-146965 A | 6/1996 |

* cited by examiner

*Primary Examiner*—Jeffrey Donels
(74) *Attorney, Agent, or Firm*—Birch, Stewart, Kolasch & Birch, LLP

(57) ABSTRACT

Resonance is realized at a desired plurality of tone pitches even after the musical tone signals of a plurality of channels have been synthesized; synthesized musical tone signals are successively delayed, the musical tone signals that are successively delayed are weighted, synthesized and output; the delayed, weighted, synthesized and outputted musical tone signals are fed back, and a series of successive delays, weights, synthesizes and outputs by the feed back are repeated and thus resonance characteristics is imparted; the amount of weighting the musical tone signals successively delayed is determined based upon a relationship among the delay feedback period, the period of sampling the generated musical tone signals and the tone pitch period of the resonance sound imparted with resonance characteristics, and a frequency of the resonance characteristics are determined; Therefore, the resonance characteristics are added at a desired tone pitch after the plurality of musical tone signals are synthesized into one. Accordingly, the resonance processing is conducted very simply.

23 Claims, 17 Drawing Sheets

FIG. 7

TONE PITCHES C4.E4.G4 ARE CONCURRENTLY SOUNDED
DAMPER PEDAL IS NOT DEPRESSED

| TONE PITCH | RES. COE. k1 | RES. COE. k2 | RES. COE. k3 | RES. COE. k4 | RES. COE. k5 | RES. COE. k6 | RES. COE. k7 | RES. COE. k8 | DAMPER PEDAL DP (RES. BALANCE) |
|---|---|---|---|---|---|---|---|---|---|
| C4 | 0 | 0 | 0 | 0 | 0 | 0 | 0.36 | 0.64 | 1.00 |
| C#4 | 0 | 0 | 0 | 0 | 0 | 0 | 0.78 | 0.22 | 0.00 |
| D4 | 0 | 0 | 0 | 0 | 0 | 0.19 | 0.81 | 0 | 0.00 |
| D#4 | 0 | 0 | 0 | 0 | 0 | 0.57 | 0.43 | 0 | 0.00 |
| E4 | 0 | 0 | 0 | 0 | 0 | 0.93 | 0.07 | 0 | 1.00 |
| F4 | 0 | 0 | 0 | 0 | 0.27 | 0.73 | 0 | 0 | 0.00 |
| F#4 | 0 | 0 | 0 | 0 | 0.59 | 0.41 | 0 | 0 | 0.00 |
| G4 | 0 | 0 | 0 | 0 | 0.90 | 0.10 | 0 | 0 | 1.00 |
| G#4 | 0 | 0 | 0 | 0.18 | 0.82 | 0 | 0 | 0 | 0.00 |
| A4 | 0 | 0 | 0 | 0.45 | 0.55 | 0 | 0 | 0 | 0.00 |
| A#4 | 0 | 0 | 0 | 0.71 | 0.29 | 0 | 0 | 0 | 0.00 |
| B4 | 0 | 0 | 0 | 0.95 | 0.05 | 0 | 0 | 0 | 0.00 |
| | 0 | 0 | 0 | 0 | 0.90 | 1.03 | 0.43 | 0.64 | |
| | | | | | | | | 0.64×1.00+0.22×0.00 | |

CUMULATIVE ADDITION SYN. INTERPOLATION RES. COE.S

FIG. 8

TONE PITCHES C4, E4, G4 ARE CONCURRENTLY SOUNDED
DAMPER PEDAL IS COMPLETELY DEPRESSED

| TONE PITCH | RES. COE. k 1 | RES. COE. k 2 | RES. COE. k 3 | RES. COE. k 4 | RES. COE. k 5 | PES. COE. k 6 | RES. COE. k 7 | PES. COE. k 8 | DAMPER PEDAL DP (RES BALANCE) |
|---|---|---|---|---|---|---|---|---|---|
| C4 | 0 | 0 | 0 | 0 | 0 | 0 | 0.36 | 0.64 | 1.00 |
| C#4 | 0 | 0 | 0 | 0 | 0 | 0 | 0.78 | 0.22 | 1.00 |
| D4 | 0 | 0 | 0 | 0 | 0 | 0.19 | 0.81 | 0 | 1.00 |
| D#4 | 0 | 0 | 0 | 0 | 0 | 0.57 | 0.43 | 0 | 1.00 |
| E4 | 0 | 0 | 0 | 0 | 0 | 0.93 | 0.07 | 0 | 1.00 |
| F4 | 0 | 0 | 0 | 0 | 0.27 | 0.73 | 0 | 0 | 1.00 |
| F#4 | 0 | 0 | 0 | 0 | 0.59 | 0.41 | 0 | 0 | 1.00 |
| G4 | 0 | 0 | 0 | 0 | 0.90 | 0.10 | 0 | 0 | 1.00 |
| G#4 | 0 | 0 | 0 | 0.18 | 0.82 | 0 | 0 | 0 | 1.00 |
| A4 | 0 | 0 | 0 | 0.45 | 0.55 | 0 | 0 | 0 | 1.00 |
| A#4 | 0 | 0 | 0 | 0.71 | 0.29 | 0 | 0 | 0 | 1.00 |
| B4 | 0 | 0 | 0 | 0.95 | 0.05 | 0 | 0 | 0 | 1.00 |
| | 0 | 0 | 0 | 2.29 | 3.47 | 2.93 | 2.45 | 0.86 | |
| | | | | | | | | 0.64×1.00+0.22×1.00 | |

CUMULATIVE ADDITION SYN. INTERPOLATION RES. COE.S

FIG. 9

TONE PITCHES C4, E4, G4, ARE CONCURRENTLY SOUNDED
DAMPER PEDAL IS HALF-DEPRESSED

| TONE PITCH | RES. COE. k 1 | RES. COE. k 2 | RES. COE. k 3 | PES. COE. k 4 | PES. COE. k 5 | RES. COE. k 6 | RES. COE. k 7 | PES. COE. k 8 | DAMPER PEDAL DP (RES. BALANCE) |
|---|---|---|---|---|---|---|---|---|---|
| C4 | 0 | 0 | 0 | 0 | 0 | 0 | 0.36 | 0.64 | 1.00 |
| C#4 | 0 | 0 | 0 | 0 | 0 | 0 | 0.78 | 0.22 | 0.60 |
| D4 | 0 | 0 | 0 | 0 | 0 | 0.19 | 0.81 | 0 | 0.60 |
| D#4 | 0 | 0 | 0 | 0 | 0 | 0.57 | 0.43 | 0 | 0.60 |
| E4 | 0 | 0 | 0 | 0 | 0 | 0.93 | 0.07 | 0 | 1.00 |
| F4 | 0 | 0 | 0 | 0 | 0.27 | 0.73 | 0 | 0 | 0.60 |
| F#4 | 0 | 0 | 0 | 0 | 0.59 | 0.41 | 0 | 0 | 0.60 |
| G4 | 0 | 0 | 0 | 0 | 0.90 | 0.10 | 0 | 0 | 1.00 |
| G#4 | 0 | 0 | 0 | 0.18 | 0.82 | 0 | 0 | 0 | 0.60 |
| A4 | 0 | 0 | 0 | 0.45 | 0.55 | 0 | 0 | 0 | 0.60 |
| A#4 | 0 | 0 | 0 | 0.71 | 0.29 | 0 | 0 | 0 | 0.60 |
| B4 | 0 | 0 | 0 | 0.95 | 0.05 | 0 | 0 | 0 | 0.60 |
| | 0 | 0 | 0 | 1.37 | 2.44 | 2.17 | 1.64 | 0.77 | |
| | | | | | | | | 0.64×1.00+0.22×0.60 | |

CUMULATIVE ADDITION SYN. INTERPOLATION PES. COE.S

FIG. 10

| TONE PITCHES A4, B4, ARE KEYED ON FIRST, TONE PITCHES C4, E4, G4, ARE KEYED ON NEXT, AND NONE OF THEM ARE KEYED OFF | | | | | | | | | |
|---|---|---|---|---|---|---|---|---|---|
| TONE PITCH | RES. COE. k 1 | RES. COE. k 2 | RES. COE. k 3 | RES. COE. k 4 | PES. COE. k 5 | RES. COE. k 6 | RES. COE. k 7 | RES. COE. k 8 | DAMPER PEDAL DP (RES. BALANCE) |
| C 4 | 0 | 0 | 0 | 0 | 0 | 0 | 0. 36 | 0. 64 | 1. 00 |
| C # 4 | 0 | 0 | 0 | 0 | 0 | 0 | 0. 78 | 0. 22 | 0. 00 |
| D 4 | 0 | 0 | 0 | 0 | 0 | 0. 19 | 0. 81 | 0 | 0. 00 |
| D # 4 | 0 | 0 | 0 | 0 | 0 | 0. 57 | 0. 43 | 0 | 0. 00 |
| E 4 | 0 | 0 | 0 | 0 | 0 | 0. 93 | 0. 07 | 0 | 1. 00 |
| F 4 | 0 | 0 | 0 | 0 | 0. 27 | 0. 73 | 0 | 0 | 0. 00 |
| F # 4 | 0 | 0 | 0 | 0 | 0. 59 | 0. 41 | 0 | 0 | 0. 00 |
| G 4 | 0 | 0 | 0 | 0 | 0. 90 | 0. 10 | 0 | 0 | 1. 00 |
| G # 4 | 0 | 0 | 0 | 0. 18 | 0. 82 | 0 | 0 | 0 | 0. 00 |
| A 4 | 0 | 0 | 0 | 0. 45 | 0. 55 | 0 | 0 | 0 | 1. 00 |
| A # 4 | 0 | 0 | 0 | 0. 71 | 0. 29 | 0 | 0 | 0 | 0. 00 |
| B 4 | 0 | 0 | 0 | 0. 95 | 0. 05 | 0 | 0 | 0 | 1. 00 |
| | 0 | 0 | 0 | 1. 40 | 1. 50 | 1. 03 | 0. 43 | 0. 64 | |
| | | | | | | | | 0. 64×1. 00+0. 22×0. 00 | |

CUMULATIVE ADDITION SYN. INTERPOLATION RES. COE.S

HOW TO FIND RES. COE. FOR THE INTERVAL F4

RESONANCE APPARATUS, RESONANCE METHOD AND COMPUTER PROGRAM FOR RESONANCE PROCESSING

This nonprovisional application claims priority under 35 U.S.C. §119(a) on patent application Ser. No. 2001-118198 filed in JAPAN on Apr. 17, 2001, which is herein incorporated by reference.

BACKGROUND OF THE INVENTION

1. Field of the Invention

The present invention relates to a resonance apparatus, to a resonance method and to a computer program for resonance processing. More specifically, the invention relates to an apparatus for adding resonance characteristics to the generated musical tones, to a method thereof and to a computer program therefore.

2. Related Art

In a conventional apparatus for adding resonance, a plurality of musical tones are generated having frequencies that are to be resonated, the plurality of musical tones that are generated are resonated, and these musical tones are output being synthesized together.

With this resonance processing, however, the generated musical tones are each imparted with resonance before being synthesized together. Therefore, the resonance processing must be effected for each of the musical tones, and becomes very complex.

The present invention was accomplished in order to solve the above-mentioned problem, and its object is to simply execute the resonance processing.

SUMMARY OF THE INVENTION

In order to accomplish the above-mentioned object according to the present invention, a plurality of musical tone signals are generated at a predetermined sampling period and are synthesized into one. The thus synthesized musical tone signals are successively delayed. The musical tone signals that are successively delayed are weighted, synthesized and output. The delayed, weighted, synthesized and outputted musical tone signals are fedback. A series of successive delays, weights, synthesizes and outputs by the feed back are repeated and thus resonance characteristics is imparted. The amount of weighting the musical tone signals successively delayed is determined based upon a relationship among the delay feedback period, the period of sampling the generated musical tone signals and the tone pitch period of the resonance sound imparted with resonance characteristics, and whereby a frequency of the resonance characteristics are determined.

Therefore, the resonance characteristics are added at a desired tone pitch after the plurality of musical tone signals are synthesized into one. Accordingly, the resonance processing is conducted very simply.

BRIEF DESCRIPTION OF THE DRAWINGS

FIG. 7 is a diagram of a table 92 showing resonance coefficients in the resonance coefficient generator 90, and illustrates how to find the resonance coefficients k when the tone pitches C4, E4 and G4 are being sounded (inclusive of key-on and sounding-on operation, the same holds hereinafter).

FIG. 8 is a diagram of the table 92 showing resonance coefficients in the resonance coefficient generator 90, and illustrates how to find the resonance coefficients k when the tone pitches C4, E4 and G4 are being sounded, a damper pedal 7 is depressed to a maximum degree, and the damper pedal data DP is 1.00.

FIG. 9 is a diagram of the table 92 showing resonance coefficients in the resonance coefficient generator 90, and illustrates how to find the resonance coefficients k when the tone pitches C4, E4 and G4 are being sounded, a damper pedal 7 is depressed half (half pedal), and the damper pedal data DP is 0.60.

FIG. 10 is a diagram of the table 92 showing resonance coefficients in the resonance coefficient generator 90, and illustrates how to find the resonance coefficients k when the tone pitches A4 and B4 are being sounded, followed by the sounding of tone pitches C4, E4 and G4.

DETAILED DESCRIPTION OF THE PREFERRED EMBODIMENTS

1. Summary of the Embodiment

Figure 11:
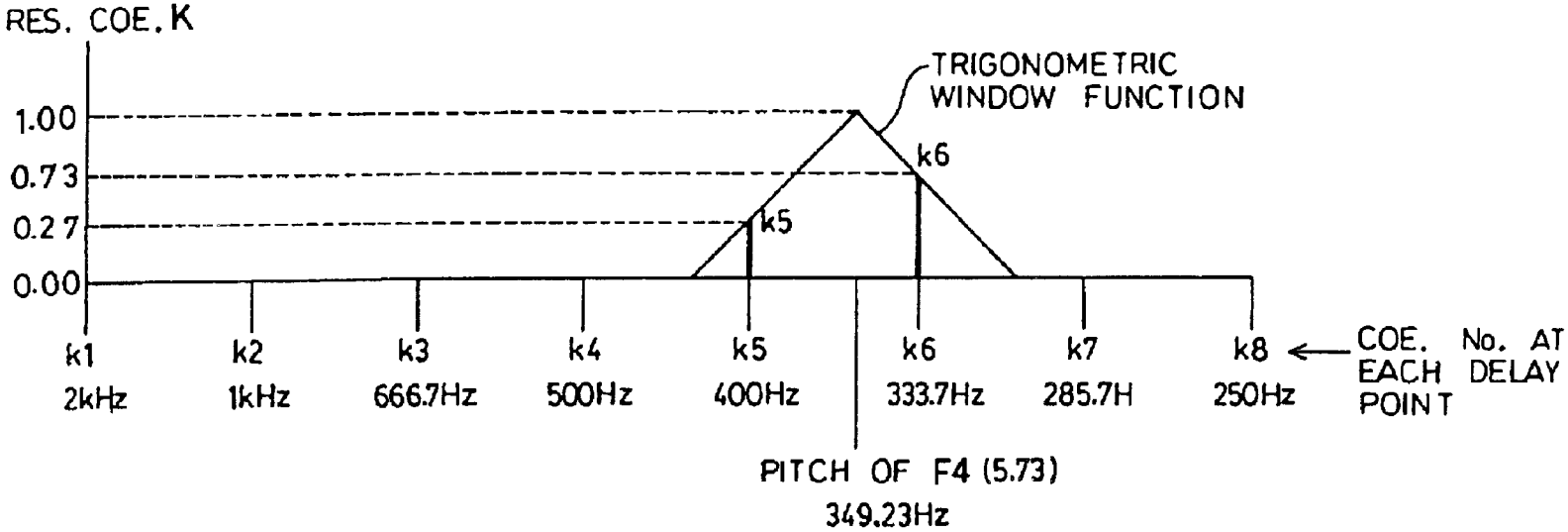
FIG. 11 is a diagram illustrating properties/characteristics of the resonance coefficients k that vary depending upon a window function.

Delay times of delay elements 61 to 68 of a resonator 50 are in agreement with sampling periods of musical tone signals. A delay period/feedback period is determined depending upon to which one of multipliers 71 to 78 a resonance coefficient k is fed. The frequency to be resonated is determined. As the value of the resonance coefficient k that is fed greatly changes from "0", the level of the resonance frequency increases, i.e., the magnitude of resonance increases. When the resonance coefficients k is fed to two of the multipliers 71 to 78 concurrently and in parallel, the resonance occurs at a frequency between the two multipliers 71 to 78 (FIG. 11). When the two resonance coefficients k are weighted differently, the value of the intermediate resonance frequency changes. When the resonance coefficients k is synthesized over a plurality of resonance tone pitches, resonance is realized at a plurality of tone pitches/frequencies.

2. Overall Circuitry

Figure 1:
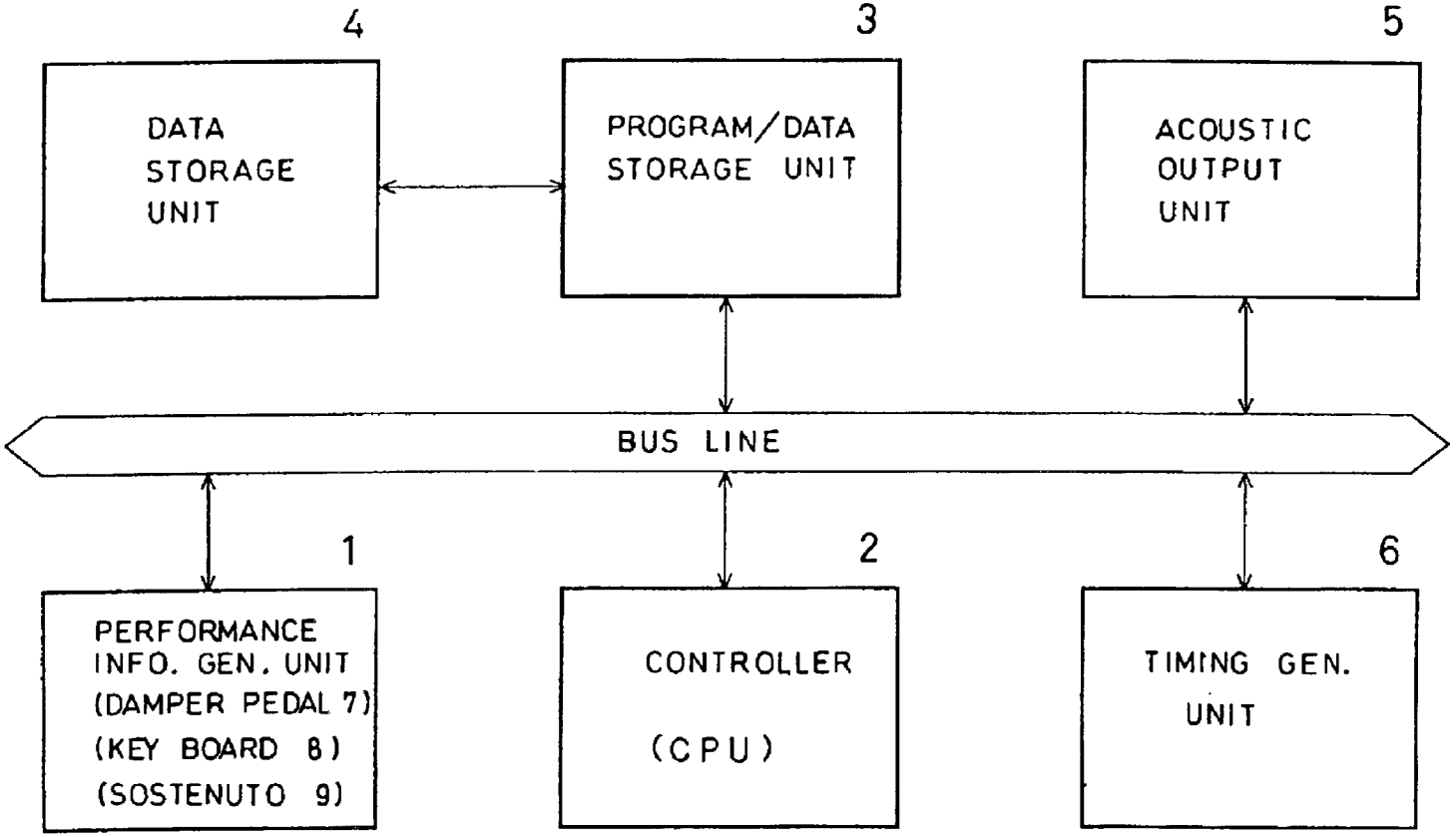
FIG. 1 is a diagram illustrating the whole circuitry of a resonance apparatus, a tone generating/controlling apparatus, or an electronic musical instrument.

FIG. 1 is a diagram illustrating the whole circuitry of a resonance apparatus, a tone generating/controlling apparatus or an electronic musical instrument. A performance information generated unit 1 generates performance information (tone generating data). The performance information (tone generating data) is for generating a musical tone. The performance information generated unit 1 may be a sound instruction device played by manual operation, an automatic play device, or may be a variety of switches or an interface.

The performance information (tone generating data) is a musical factor in which includes a tone pitch (tone pitch range, tone pitch-determining factor), a sounding time data, field data of performance information, number-of-sounds data and resonance degree data. The sounding time data represents an elapse of time from the start of sounding of a tone. The field of performance information represents part of play, part of tone, part of musical instrument, and corresponds to, for example, melody, accompaniment, chord, bass, rhythm, or corresponds to an upper keyboard, a lower keyboard or a foot keyboard.

The tone pitch data is received as a key number data KN. The key number data KN includes octave data (tone pitch range) and tone name. The field of performance information is received as part number data PN. The part number data PN is for discriminating the performance areas. The part number data PN is set depending upon from which performance area the generated tone is.

The sounding time data is received as tone time data TM and is based upon the time count data from a key-on event or is replaced by an envelope phase. The sounding time data has been closely disclosed in Japanese Patent Application No. 219324/1994 and in the drawings thereof as elapse-of-time data from the start of sounding.

The number-of-sounds data represents the number of musical tones being sounded. This number is found relying upon the number of tones of which the on/off data from the assignment memory 30 is "1" in compliance with flowcharts shown in FIGS. 9 and 15 of Japanese Patent Application No. 242878/1994, FIGS. 8 and 18 of Japanese Patent Application No. 2476855/1994, FIGS. 9 and 20 of Japanese Patent Application No. 276857/1994, and FIGS. 9 and 21 of Japanese Patent Application No. 276858/1994.

The resonance degree data is received as a resonance coefficient k. This resonance coefficient k stands for a degree of resonance of a tone that is being sounded together with other tones. The value of the resonance coefficient k is great when the ratio of a tone pitch frequency of one tone to a tone pitch frequency of other tone is a small integer such as 1:2, 2:3, 3:4, 4:5 or 5:6, but becomes small when the ratio assumes a large integer such as 9:8, 15:8, 15:16, 45:32 or 64:45. The resonance coefficient k is found based on the frequency number data FN (tone pitch) of the musical tone (direct sound), operation state of the damper pedal 7, envelope speed data ES or envelope level data EL.

The sound instruction device may be a keyboard instrument, a stringed instrument, a wind instrument, a percussion instrument or a keyboard 8 of a computer. The automatic play device automatically plays back the performance information that is stored. The interface such as MIDI (musical instrument digital interface) sends and receives performance information to, and from, the device that is connected.

The performance information generated unit 1 is further provided with a variety of switches (operation buttons). The variety of switches (operation buttons) include timbre tablets, effect switches, rhythm switches, pedals, wheels, levers, dials, handles and touch switches and are for the musical instruments. Tone control data are generating by using these switches (operation buttons). The tone control data is for controlling the musical tone. The tone control data includes musical factor data, timbre data (tone-determining factor), touch data (speed/strength of sounding instruction operation), number-of-sounds data, resonance degree data, effect data, rhythm data, sound image (stereo) data, quantize data, modulation data, tempo data, sound volume data and envelope data.

The pedals include a damper pedal 7, a sostenuto pedal 9, a sustaining pedal, a shifting pedal, a mute pedal and a soft pedal. Upon operating the damper pedal 7, the damper that inhibits the vibration of strings is separated away from all strings such as in the piano. Therefore, even after the keys are released, the strings continue to vibrate creating resonance of all strings (all tone pitches). Upon operating the sostenuto pedal 9 to be on, those tones that have been sounded due to key-on/sounding-on operation allow to be sounded continuously since the damper is released until the sostenuto pedal 9 is operated to be off.

These musical factor data are combined with the performance information (tone data), input by using various switches, combined with the automatic play data, or are combined with performance information that is transmitted and received through the interface. The touch switches provide to be corresponded to each of the sounding instruction devices to generate initial touch data representing quickness and strength of touch, and after-touch data.

The timbre data corresponds to the kind of the musical instruments (sounding media/sounding means) such as keyboard instrument (piano, etc.), wind instrument (flute, etc), stringed instrument (violin, etc.), percussion instrument (drum, etc.) and sounding means, and are received as tone number data. The envelope data includes envelope time, envelope level, envelope speed, envelope phase, etc.

Such musical factor data are sent to the controller 2 where a variety of signals that will be described later, data and parameters are changed over to determine the content of the musical tone. The performance information (tone generating data) and tone control data process by the controller 2, and various data are sent to an acoustic output unit 5 to generate musical tone signals. A CPU, a ROM or a RAM etc. constitute the tone controller 2.

A program/data storage unit 3 (internal storage medium/means) comprises a storage unit such as a ROM, a write-able RAM, a flush memory or an EEPROM. Aprogram of a computeOr stored in a data storage unit 4 (external storage medium/means) such as an optical disk or a magnetic disk, is transcribed and stored (installed/transferred) into the program/data storage unit 3. Into the program/data storage unit 3 is further stored (installed/transferred) a program transmitted from an external electronic musical instrument or a computer via the MIDI device or the transmission/reception device. The storage medium of the program includes a communication medium.

The installation (transfer/copy) is automatically executed when the data storage unit 3 is set to the tone generating device or when the power source of the tone generating device is turned on, or when the apparatus is operated by an operator. The program complies with flowcharts that will be described later, with which the controller 2 executes a variety of processings.

Another operating system, a system program (OS) and any other programs may be stored in advance in the apparatus, and the above-mentioned program may be executed together with these OS and other programs. The program may be the one which, when installed in the apparatus (body of the computer) and is executed, is capable of executing the processings and functions described in the claims by itself or together with other programs.

Further, a part of or the entire program may be executed being stored in one or more separate devices other than the apparatus, and the data to be processed or the processed data and program may be exchanged between the apparatus and separate devices through communication means, so that the present invention is executed by the apparatus and by the separate devices together.

The program/data storage unit 3 stores the above-mentioned musical factor data, the above-mentioned various data and other various kinds of data. These various kinds of data include data necessary for the time-division processing and data to be assigned to the time-division channels.

The acoustic output unit 5 generates musical tone signals in parallel in response to the data written into the assignment memory 40 to generate sound. The acoustic output unit 5 concurrently forms a plurality of musical tone signals by the time-division processing to generate polyphonic sound. The musical tone signals are generated at a predetermined sampling frequency by the digital signal processing. The acoustic output unit 5 adds resonance, reverberation and forms sound image (stereo control).

A timing generated unit 6 outputs timing control signals to the circuits to maintain synchronism of all circuits of the resonance apparatus, tone generating/control unit or electronic instrument. The timing control signals include clock signals of each of the periods, signals of a logical product or a logical sum of these clock signals, signals having periods of channel-dividing time in the time-division processing, channel number data CHNo and time count data TI etc. The time count data TI represents an absolute time, i.e., represents the elapse of time. A period from an overflow reset to a next overflow reset of the time count data TI, is set to be longer than the longest sounding time among those of the musical tones, and is set to be longer by several times depending upon the cases.

3. Assignment Memory 40

Figure 2:
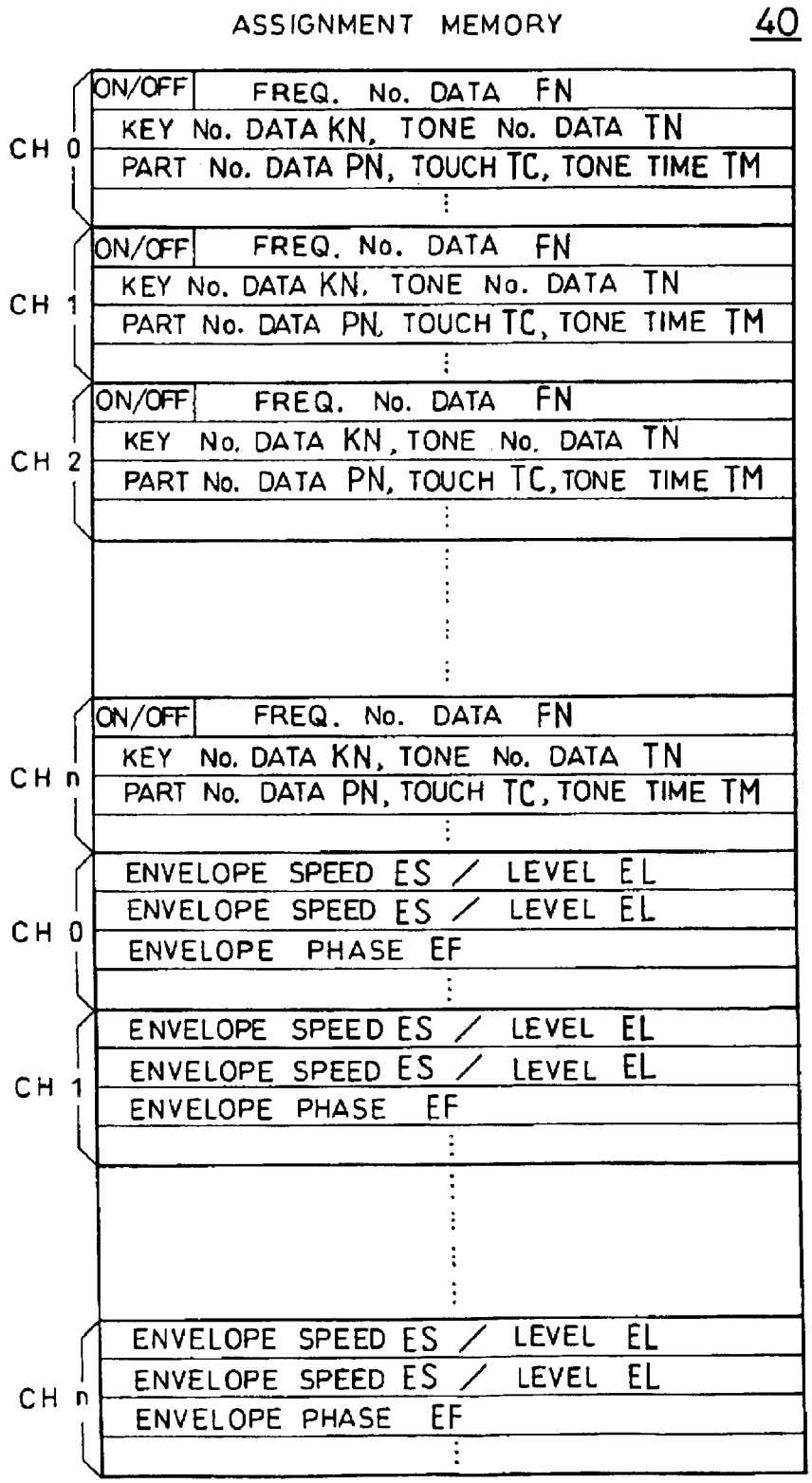
FIG. 2 is a diagram illustrating an assignment memory 40 in an acoustic output unit 5.

FIG. 2 illustrates an assignment memory 40 in the acoustic output unit 5. In the assignment memory 40 has been formed a plurality (16, 32, 64 or 128 etc.) of channel memory areas to store the data related to the musical tones assigned to a plurality of tone-generating channels formed in the acoustic output unit 5. The acoustic output unit 5 generates a plurality of musical tone signals concurrently and in parallel by the time-division processing to sound a plurality of musical tones in a polyphonic manner.

In these channel memory areas are stored frequency number data FN of a tone to which a channel is assigned, key number data N, envelope speed data ES, envelope time data ET and envelope phase data EF. There are further stored tone number data TN, touch data TC, tone time data TM, part number data PN, resonance coefficient k (resonance degree data) and on/off data.

In addition to the above-mentioned musical tones (direct sounds), these channel memory areas further store frequency number data FN of resonance sound and noise to which the channel is assigned, key number data KN, envelope speed data ES, envelope time data ET and envelope phase data EF.

There exists a simple relationship of a ratio of an integer times between a value of the frequency number data FN of a resonance sound and a value of a frequency number data FN of a direct sound. Namely, there exists a relationship of frequency ratio such as 1:n (n=1, 2, 3, 4, 5, 6, - - - ), 2:n (n=3, 5, 7, 9, 11, 13, - - - ), 3:n (n=4, 5, 7, 8, 10, 11, - - - ), 4:n (n=5, 7, 9, 11, 13, 14, - - - ) 5:n (n=6, 7, 8, 9, 11, 12, - - - ), etc.

Among them, 1:2 (octave), 2:3 (perfect fifth), 3:4 (perfect fourth), 4:5 (major third) and 5:6 (minor third) are importantly selected. Therefore, a value of the frequency number data FN of a resonance sound is found by calculating in proportion to the value of the frequency number data FN of a direct sound by the ratio of an integer number of times. Examples are 2 times, 3/2 times, 4/3 times, 5/4 times, - - - , 3 times, 4 times, 5 times, - - - .

The frequency number data FN of the resonance sound which is calculated proportional can be replaced by a key number data KN of the closest tone pitch. However, there exists a slight deviation between a value of the frequency number data FN that corresponds to the key number data KN of the closest tone pitch and a value of the frequency number data FN of a resonance sound that is proportionally calculated due to an "S-curve tuning". Therefore, in order to realize a ratio of a perfect integer number of times, frequency number data FN that is calculated proportional is used. Otherwise, key number data KN of a tone pitch close to a value that is calculated proportional is used.

The envelope speed data ES or the envelope level data EL of the resonance sound is calculated in proportion to the ratio of an integer number of times of the frequency number data FN with respect to the envelope speed data ES or the envelope level data EL of the direct sound, and is multiplied by 1/2 times, 2/3 times, 3/4 times, 4/5 times, - - - , 1/3 times, 1/4 times, 1/5 times, - - - . The number of data of the resonance sound to be formed is fixed to 2, 3, 4, 5, - - - with respect to a direct sound. Formation of the data of a resonance sound of which the proportionally calculated result is smaller than a predetermined value, may be inhibited.

As described above, the resonance sound has the same tone data TN and the same tone waveform with respect to the direct sound. The amplitude of envelope of the resonance sound decreases depending upon the above proportional calculation. When harmonics of a sine wave of a formed tone are synthesized, the number of the synthesized sine waves of the direct sound becomes smaller than the number of the synthesized sine waves of the resonance sound, and the synthesized sounds of higher frequencies are cut. The number of the synthesized sine waves of the direct sound may be the same as the number of the synthesized sine waves of the resonance sound, as a matter of course.

The value of the frequency number data FN of noise is the same as the value of the frequency number data FN of the direct sound or is fixed and remains constant irrespective of the tone pitch of the direct sound. Here, however, noise has a tone data TN and tone waveform different from those of the direct sound. The amplitude of envelope of the noise becomes smaller than that of the direct sound but may be the same. The noise has a nature of the "resonance sound" of the direct sound and has the same frequency. The value of the frequency number data FN of noise may be calculated from the value of the frequency number data FN of the direct sound.

The on/off data represents whether the tone (component sound) being assigned and sounded is being the key-on or is being sounded (whether "1", key-off or sounding-off "0"). The frequency number data FN represents a frequency of a tone that is assigned and is sounding, and is converted from the key number data KN and is multiplied by the frequency number ratio data FNR. The table (decoder) for the conversion is provided in the program/data storage unit 3.

The envelope speed data ES and the envelope time data ET are as described above. The envelope phase data EF represent an attack, a decay, a sustain and a release of the envelope of the musical tone.

The key number data KN represents a tone pitch (frequency) of a musical tone that is assigned and sounded, and is determined depending upon the tone pitch data. The key number data KN is stored for all component sounds that constitute a musical tone. Every time when there is an on event and the component sounds are assigned to the channels and are synthesized, the key number data KN is additionally stored in the channel memory area of the assignment memory 40, and the corresponding key number data KN is erased for every off event. The high-order data in the key number data KN represents a tone pitch range or an octave, and the low-order data represents a tone name.

The tone number data TN represents the timbre of the tone that is assigned and sounded, and is determined depending upon the timbre data. When the tone number data TN differs, the timbre differs and the waveform of the tone differs, too. The touch data TC represents the quickness or strength of the sounding operation, is found based on the operations of the step switches, and is determined depending upon the touch data. The part number data PN represents the performance areas as described above, and is set depending upon from which performance area the musical tone is sounded. The tone time data TM represents the elapse of time from the key-on event.

The data of these channel memory areas are written at on-timing and/or off-timing, rewritten or read out for each of the channel timings, and are processed through the acoustic output unit 5. The assignment memory 40 may be provided in the program/data storage unit 3 or in the controller 2 instead of in the acoustic output unit 5.

The methods of assigning or truncating the tones into the channels formed by the time-division processing, i.e., into a plurality of tone-generating systems for generating a plurality of tones (component sounds) in parallel and in a polyphonic manner, have been taught in, for example, Japanese Patent Application No. 42298/1989, Japanese Patent Application No. 305818/1989, Japanese Patent Application No. 312175/1989, Japanese Patent Application No. 2089178/1990, Japanese Patent Application No. 409577/1990 and Japanese Patent Application No. 409578/1990.

4. Acoustic Output Unit 5

Figure 3:
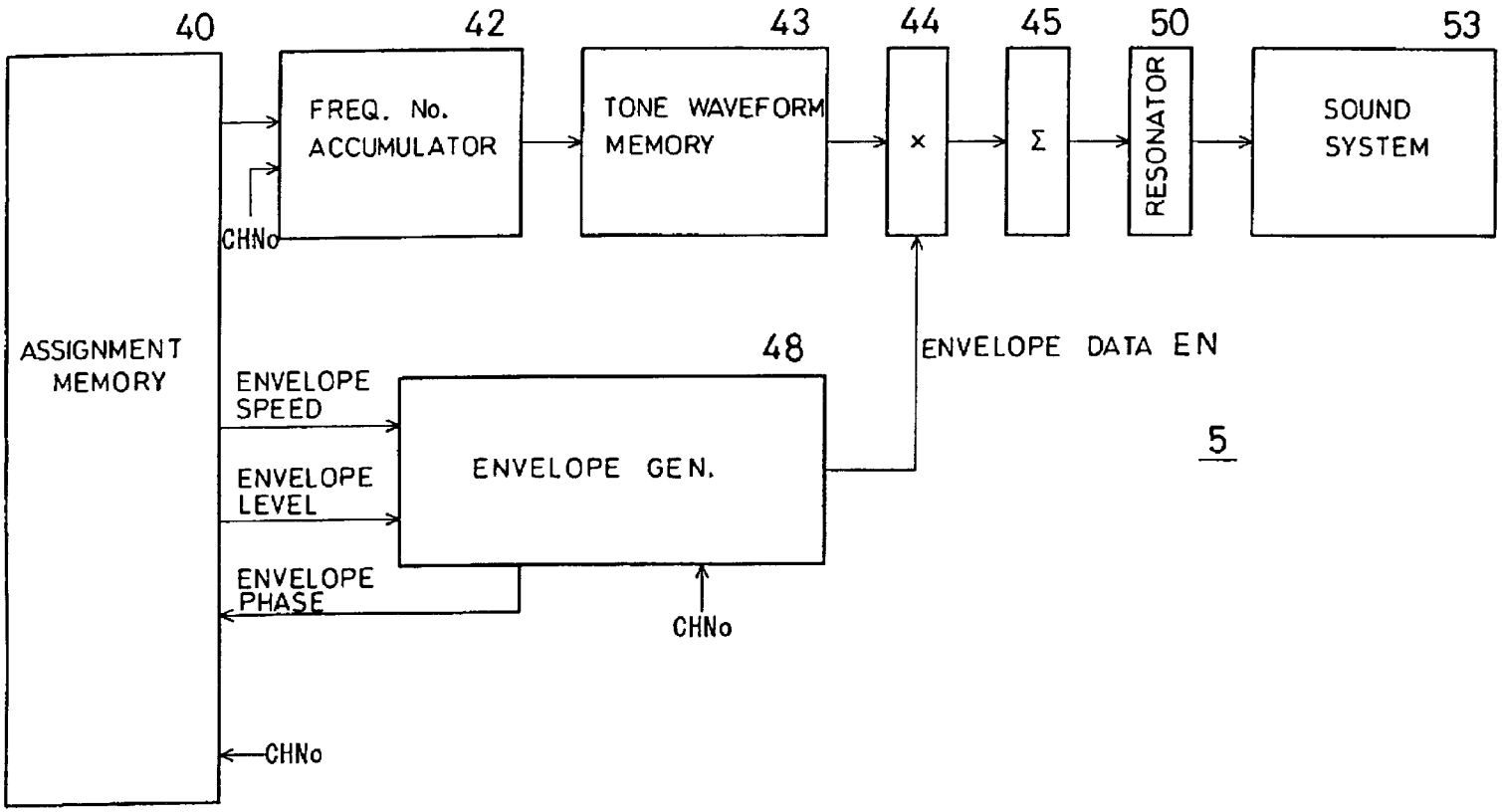
FIG. 3 is a diagram illustrating the acoustic output unit 5 in the whole circuitry.

FIG. 3 is a diagram illustrating the acoustic output unit 5. The frequency number data FN from the channels of the assignment memory 40 are sent to a frequency number accumulator 42 where they are accumulated in a time-division manner, and tone waveform data MW are read out from a tone waveform memory 43 at a speed (tone pitch) that corresponds to the frequency number data FN in a time-division manner. The tone waveform data MW are read out at a predetermined sampling frequency due to the digital signal processing. The tone waveform data MW that are read out are multiplied and synthesized by the envelope data EN through the multiplier 44, accumulated and synthesized with the tone waveform data of all channels through an accumulator 45, added with a resonance effect through a resonator 50, and are sounded through a sound system 53.

Various waveforms of the tone waveform data MW are stored depending upon the tone number data TN, touch data TC, part number data PN, and tone time data TM. Corresponding tone waveform data MW are read out based upon the tone number data TN, touch data TC, part number data PN, and tone time data TM. The tone number data TN, touch data TC, part number data PN and tone time data TM are successively read out in a Time-division manner from the assignment memory 40 for each of the channels, and are sent to the tone waveform memory 43 from where the tone waveform data MW are successively read out in a time-division manner.

The envelope speed data ES and the envelope level data EL of each of the channels of the assignment memory 40 are sent to an envelope generator 48 where the envelope data EN are operated in a time-division manner and are sent to the multiplier 44. The envelope generator 48 has areas corresponding to the number of the time-division channels, where the envelope data EN of each of the channels are stored to operate the envelope for each of the channels.

The address of the memory in the envelope generator 48 is specified by the channel number data CHNo. The specified address only is written/read out or is reset. The channel areas of the memory in the envelope generator 48 are separately reset (cleared) by an off-event signal and/or an on-event signal.

The acoustic output units 5 are provided in a number corresponding to the number of the stereo channels (audio channels) that form a sound image. A sound image is stored in the channel areas of the assignment memories 40 of the stereo (audio) channels. The sound image data are multiplied and synthesized by the tone waveform data or the envelope data EN of the channels through the multiplier 43, thereby to form a sound image. Systems for assigning the channels of the stereo (audio) channel system have been taught in the specifications and drawings of Japanese Patent Applications Nos. 204404/1991 and 408859/1990.

5. Resonator 50

Figure 4:
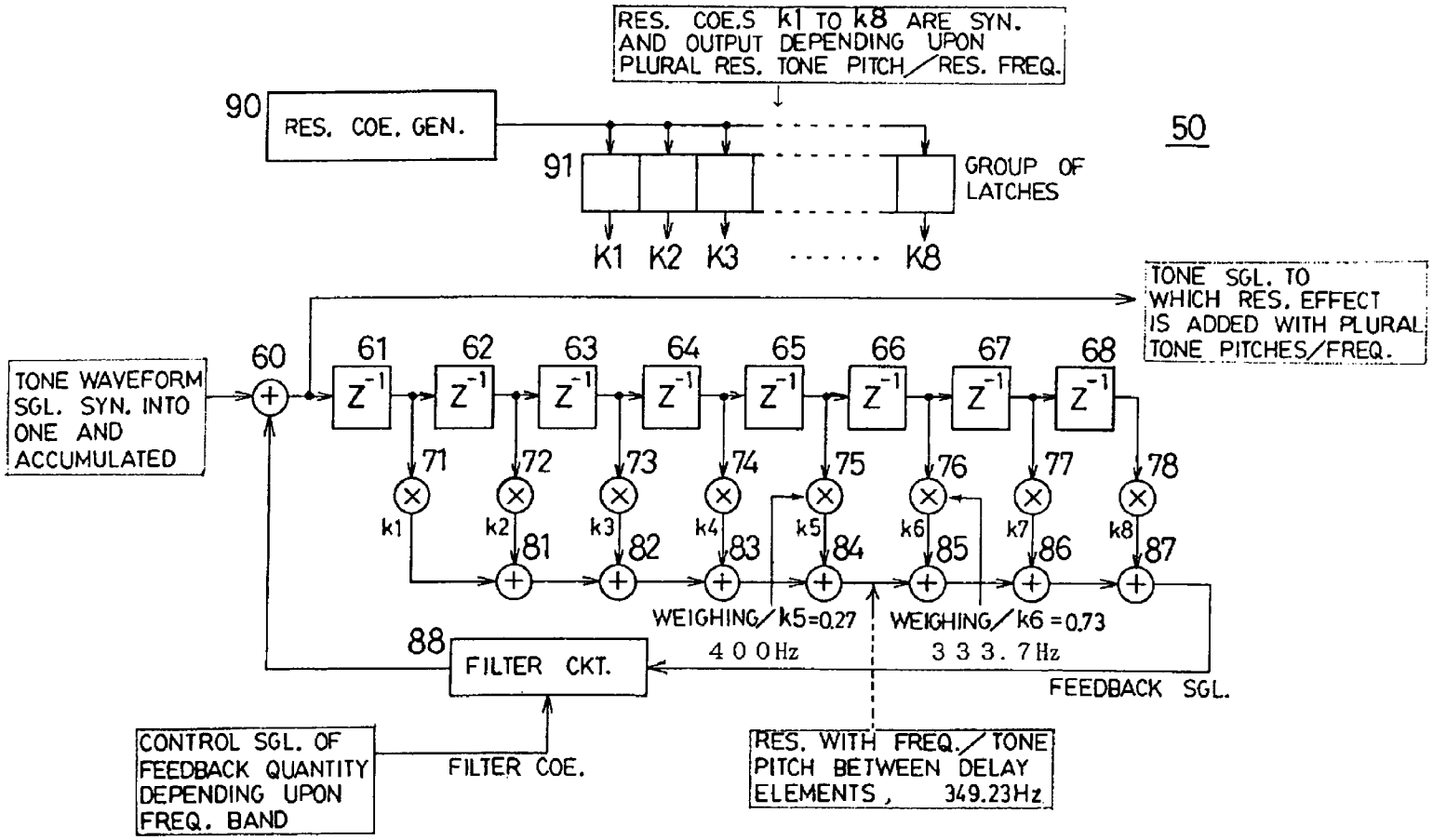
FIG. 4 is a diagram illustrating a resonator 50 in the acoustic output unit 5.

FIG. 4 is a diagram illustrating the resonator 50. Tone waveform data MW from the accumulator 44 accumulated for all of the channels pass through an adder 60 and are successively delayed through eight stages of delay elements 61, 62, 63, 64, 65, 66, 67 and 68. The delay amounts (delay times) through the delay elements 61 to 68 are in agreement with the sampling periods of the tone waveform data MW and of the envelope data EN, and are in agreement with all channel times in the time-division processing.

For example, when the number of the time-division channels of the apparatus is "16", the delay amounts (delay times) of the delay elements 61 to 68 are 16 channel times. The number of the delay elements 61 to 68 is in agreement with the octave number of the tones that can be produced by the apparatus, or with the octave number +1 or the octave number +2. The number of the delay elements 61 to 68 may be smaller than the octave number like 1/2, 1/3, 1/4, 1/5, - - - of the octave number, or may be larger than the octave number like 2 times, 3 times, 4 times, 5 times, - - - of the octave number. Thus, the number of stages of the successive delay corresponds to, is in agreement with, is an integer number of times as great as, or is one divided by an integer of, the octave number of the tones generated by the resonator.

The delay outputs of the delay elements 61 to 68 are multiplied by resonance coefficients k1, k2, k3, k4, k5, k6, k7 and k8 through multipliers 71, 72, 73, 74, 75, 76, 77 and 78, are added up successively through adder 81, 82, 83, 84, 85, 86 and 87, are filtered through a filter circuit 88, and are fed back, added and synthesized to the tone waveform data MW that have been accumulated through the adder 60.

The delay period/feedback period is determined and the resonance frequency is determined depending upon to which one of the multipliers 71 to 78 the resonance coefficient k is fed. For example, the multiplier 72 permits the tone waveform data MW to be fed back and to repetitively pass through at a period twice as long as the sampling period. When the resonance coefficient k is fed to the multiplier 72, the tone pitch resonates at a frequency to which is one-half the sampling frequency.

The multiplier 73 permits the tone waveform data MW to be fed back and to repetitively pass through at a period three times as long as the sampling period. When the resonance coefficient k is fed to the multiplier 73, therefore, the tone pitch resonates at a frequency to which is one-third the sampling frequency. The multiplier 75 permits the tone waveform data MW to be fed back and to repetitively pass through at a period five times as long as the sampling period. When the resonance coefficient k is fed to the multiplier 75, therefore, the tone pitch resonates at a frequency to which is one-fifth the sampling frequency.

The multiplier 78 permits the tone waveform data MW to be fed back and to repetitively pass through at a period eight times as long as the sampling period. When the resonance coefficient k is fed to the multiplier 78, therefore, the tone pitch resonates at a frequency to which is one-eighth the sampling frequency. Namely, the tone waveform data MW are successively delayed at a period of a tone pitch of a resonance sound. Thus, the tone waveform data MW that are delayed are fed back by the adder 60 to repeat a series of successive delays. The resonance characteristics are thus added.

As the number of the delay elements 61 to 68 and of the multipliers 71 to 78 are successively increased, the tone pitch resonates at a frequency 1/n or n times of the sampling frequency. Therefore, the delay period/feedback period are in agreement with, are an integer times as great as, or are the ones divided by an integer of, the sampling period.

The delay times (delay amounts) of the delay elements 61 to 68 may be 2 times, 3 times, 4 times, 5 times, - - - , 1/2 times, 1/3 times, 1/4 times, 1/5 times, - - - of the sampling period. In this case, too, therefore, the delay period/feedback period are in agreement with, are an integer times as great as, or are the ones divided by an integer of, the sampling period.

As the delay times (delay amounts) of the delay elements 61 to 68 undergo a change, the multipliers 71 to 78 that feed the resonance coefficient k are changed over. The tone signals to be successively delayed are determined based upon a corresponding relationship among the delay period/feedback period, the period for sampling the tone waveform data MW that are generated and the frequency of the tone waveform data MW to which resonance is added, i.e., the period of the tone pitch of a resonance sound having resonance characteristics.

As the value of the resonance coefficient k that is fed is changed over to gradually increase starting from "0", the level of the resonance frequency/resonance tone pitch (resonance frequency) gradually increases, i.e., the magnitude of resonance gradually increases. Further, as the resonance coefficients k are concurrently fed in parallel to the neighboring two multipliers among the plurality of multipliers 71 to 78, an intermediate frequency between the two of the multipliers 71 to 78 resonates. The resonance coefficients k may be concurrently fed in parallel to the neighboring three, four or more multipliers among the plurality of multipliers 71 to 78, as a matter of course. The tone signals that are successively delayed are weighted for the outputs of the neighboring two, three, four or more delay means.

By changing the weighting of the two resonance coefficients k fed to the two multipliers among the multipliers 71 to 78, the value of the intermediate resonance frequency can be changed. The weighting amount/level of the tone waveform data MW to be successively delayed are determined based upon a corresponding relationship among the delay period/feedback period, the period for sampling the tone waveform data MW that are generated, and the frequency of the tone waveform data MW to which resonance is added, i.e., the period of the tone pitch of a resonance sound having resonance characteristics. Therefore, the weighting becomes the greatest for the delay output corresponding to the delay period/feedback period that varies depending upon the period of the tone waveform data MW to which resonance is added.

As described above, the synthesized tone waveform data MW are successively delayed by the period of a tone pitch of a resonance sound. The tone waveform data MW that are delayed successively are weighted respectively, synthesized, and are output. The delayed tone waveform data MW are fed back, and a series of successive delays are repeated. Thus, resonance characteristics are added.

The filter circuit 88 controls the overall feedback amount in the resonance, so that frequency characteristics/frequency spectral components of the tone waveform data MW to which resonance is added are placed in a desired state. The tone waveform data MW from the adder 60 to which resonance is added, are sent to the sound system 53.

The assignment memory 40 feeds key number data KN or frequency number data FN of the tones of the channels to the resonance coefficient generator 90, and the performance information generated unit 1 feeds damper pedal data DP that represents the operation state of the damper pedal 7 to the resonance coefficient generator 90. The resonance coefficient generator 90 calculates the resonance coefficients k and feeds them to the multipliers 71 to 78 through a group of latches 91. The latches 91 include eight latches to correspond to the multipliers 71 to 78.

6. Resonance Coefficient Generator 90

Figure 5:
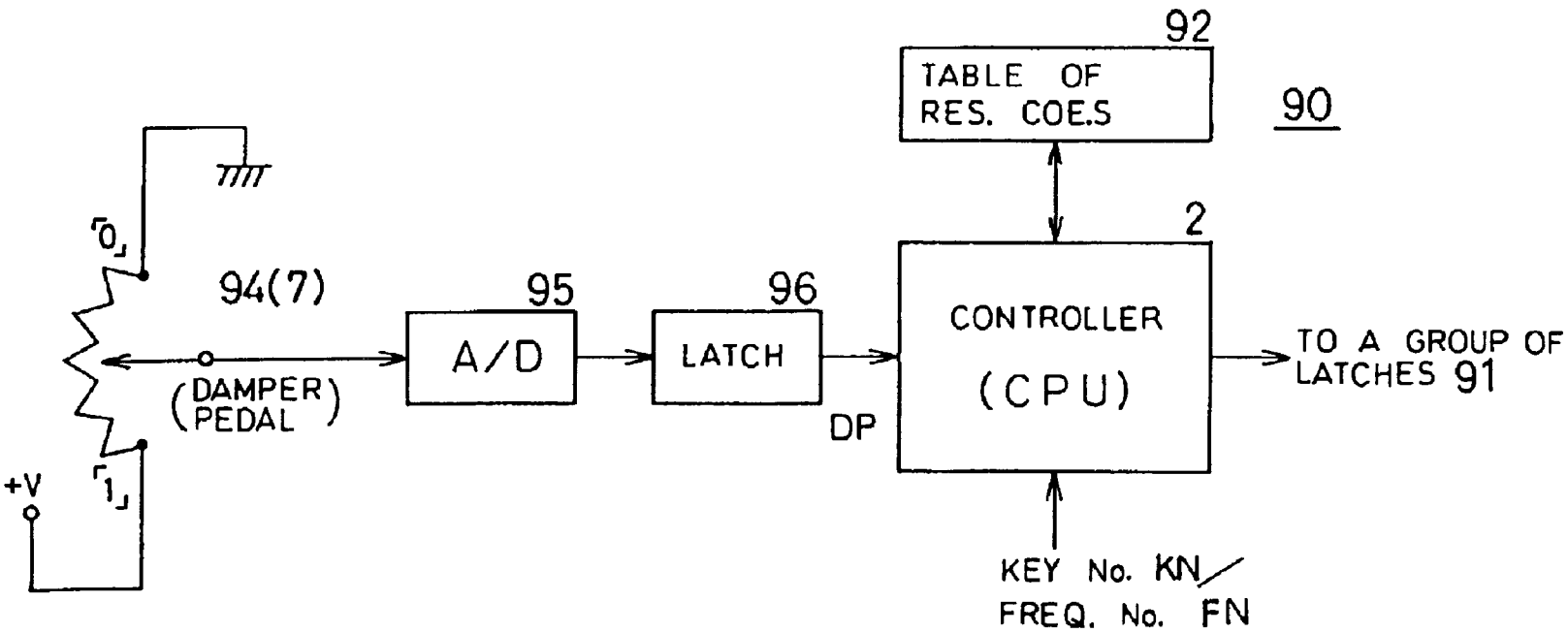
FIG. 5 is a diagram illustrating a resonance coefficient generator 90 in the acoustic output unit 5.

FIG. 5 is a diagram illustrating the resonance coefficient generator 90. Based upon the key number data KN or the frequency number data FN of the channels, corresponding resonance coefficients k are read out from a table 92 of resonance coefficients, and the damper pedal data DP are multiplied/operated and are stored in the group of latches 91. The controller (CPU) 2 executes these read/operation/storage processings. The CPU/ROM/RAM different from the controller 2 may execute, as a matter of course.

A position/angle sensor 94 constituted by a variable resistor is connected to the damper pedal 7 or to the sostenuto pedal 9 in the performance information generated unit 1. The position/angle sensor 94 constituted by the variable resistor produces a voltage signal of a level corresponding to the depressed amount of the damper pedal 7 or the sostenuto pedal 9. The voltage signal is converted into a digital data through an A-D converter 95, and is fed as the damper pedal data DP to the controller 2 through a latch 96.

7. Processing for Generating Resonance Coefficients k

Figure 6:
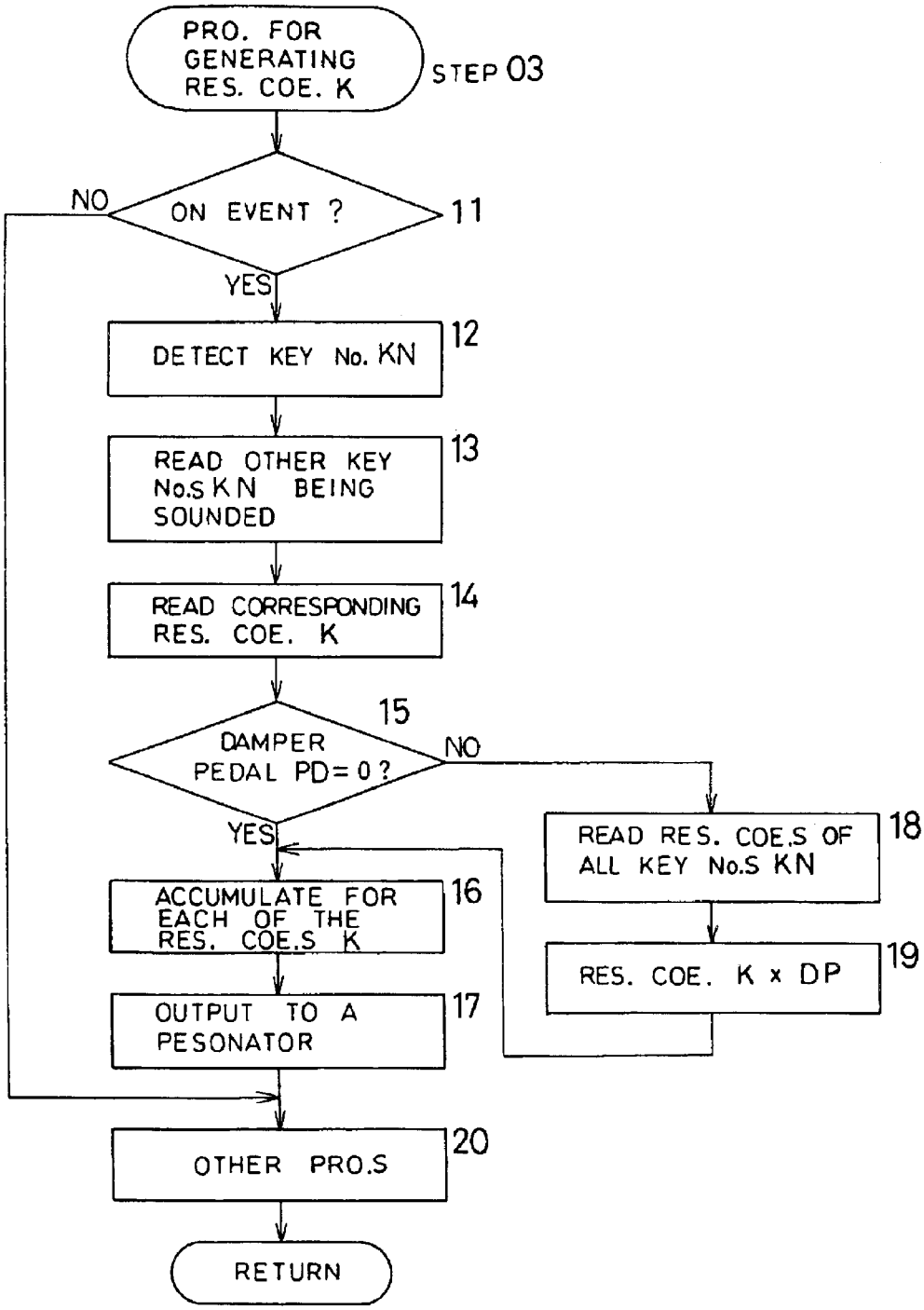
FIG. 6 is a diagram of a flowchart illustrating a processing for generating resonance coefficients k (step 03).

FIG. 6 is a diagram of a flowchart of a processing for generating resonance coefficients k. A program corresponding to this flowchart executes by the controller 2. The processing of FIG. 6 is executed in the sounding processing of step 03 that will be described later. First, when there is a key-on event (step 11), a key number data KN related to the key-on event is detected (step 12), and there are read out other key number data KN of tone data of the channels being sounded with the on/off data in the assignment memory 40 being "1" (step 13).

Based on the key number data KN that are being sounded, one or a plurality of corresponding resonance coefficients k1 to k8 are read out from the table 92 of resonance coefficients (step 14). When the damper pedal data DP is "0" and the damper pedal 7 has not been depressed (step 15), the resonance coefficients k1 to k8 which are read out are accumulated for each of the key number data KN (step 16), are stored in the group of latches 91, and are fed to the multipliers 71 to 78 of the resonator 50 (step 17).

Figure 17:
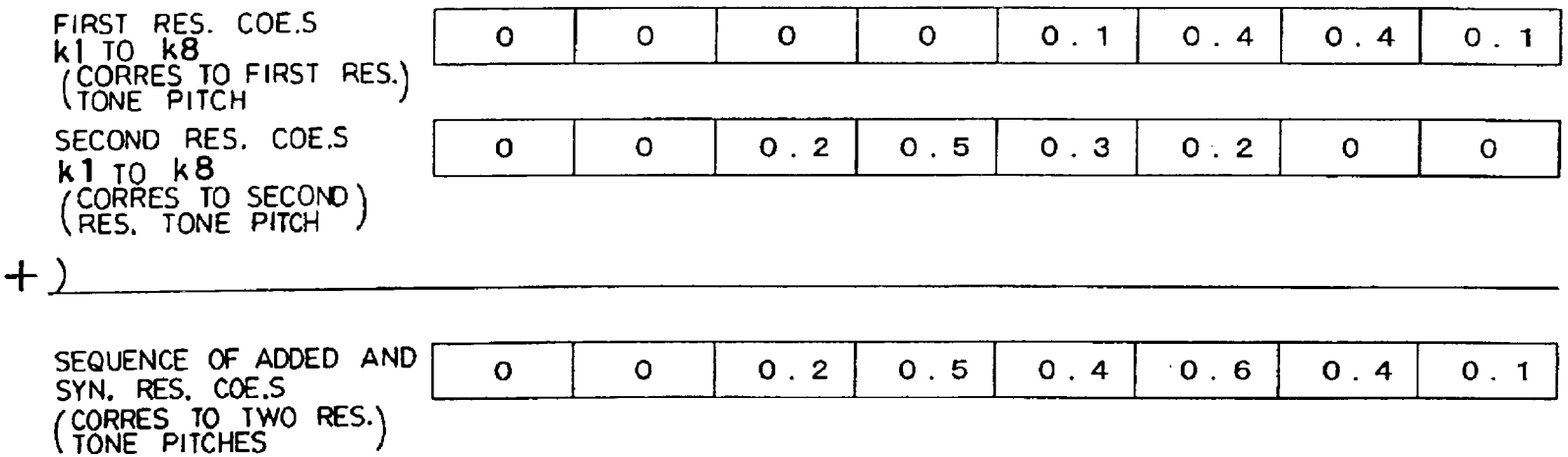
FIG. 17 is a diagram illustrating the conditions of accumulated synthesis (additional synthesis/operational synthesis) for each of the resonance tone pitches/resonance frequencies at step 16.

FIG. 17 illustrates a state of accumulation and synthesis (addition/operation/synthesis) for each of the resonance tone pitches/resonance frequencies at step 16. A first sequence of resonance coefficients k1 to k8 and a second sequence of resonance coefficients k1 to k8, are corresponding to different resonance tone pitches/resonance frequencies. When they are accumulated and synthesized, and are fed to the resonator 50, a resonance is realized for a plurality of resonance tone pitches/resonance frequencies, if one sequence of resonance coefficients are fed, i.e., one sequence that is fed is weighted or the delay elements 61 to 68 are those of one sequence connected in series.

Thus, there are generated resonance coefficients k1 to k8 determined depending upon the key number data KN of during the sounding operation/during the key-on/during the sounding, and resonance is effected depending upon the tone pitches of the tones being sounded. The tone signals synthesized into one are resonated at a plurality of resonance frequencies/resonance tone pitches, and are weighted depending upon the plurality of resonance frequencies/resonance tone pitches.

The resonance frequencies/resonance tone pitches are in agreement with the tone pitches of tone signals that constitute tone signals that are synthesized into one. Depending upon the cases, however, tone pitches/frequencies of an integer times of the tone pitch frequencies are weighted and resonated. Accordingly, the resonance frequencies/resonance tone pitches are corresponding to the tone pitches of the tone signals constituting the tone signals that are synthesized into one.

When the damper pedal data DP is not "0" and the damper pedal 7 has been depressed (step 15), there are read out one or a plurality of resonance coefficients k1 to k8 in other key number data KN for which the key has not been turned on (step 18), which are then multiplied by the damper pedal data DP from the latch 96 (step 19). The resonance coefficients k1 to k8 that are read out are accumulated for each of the key number data KN (step 16), stored in the group of latches 91 (step 17), and are fed to the multipliers 71 to 78 of the resonator 50.

Thus, as the damper pedal 7 is depressed, there are generated resonance coefficients k1 to k8 determined depending upon the key number data KN of when the sounding operation has not been effected/keyed-off/sounded-off, and the resonance is effected for all tone pitches of all musical tones from which the damper has been removed. The resonance coefficients k1 to k8 of all tone pitches operated at step 19 may be stored in the memory in advance, and may be read out after the operation of the damper pedal data DP is detected. In this case, the resonance coefficients k1 to k8 that are read out may be multiplied by the damper pedal data DP.

Figure 16:
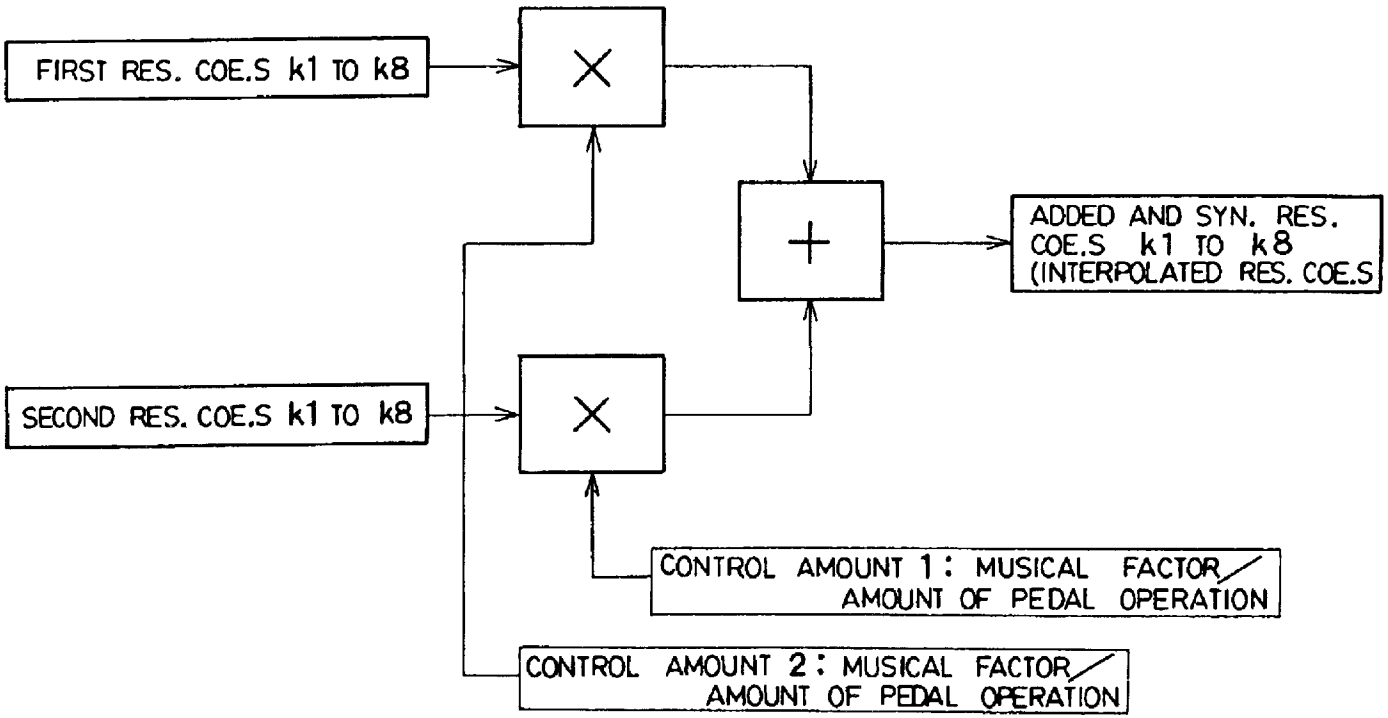
FIG. 16 is a diagram of a circuit for executing the control with a different amount of resonance for every resonance frequency/resonance tone pitch.

The resonance amount is the same for each of the plurality of resonance frequencies/resonance tone pitches. The resonance amount, however, differs depending upon the cases as shown in FIG. 16. For example, the value of the resonance tone pitch/resonance frequency is divided/operated by the resonance coefficients k1 to k8 output at steps 16 and 17. Therefore, the resonance amount increases as the pitch of the tone decreases, and varies depending upon the tone pitch/frequency of the resonance sound. That is, the magnitude of the resonance sound of a low tone pitch is larger than the magnitude of the resonance sound of a high tone pitch. The resonance amount may be increased with an increase in the tone pitch. In this case, the value of the resonance tone pitch/resonance frequency is multiplied/operated upon the resonance coefficients k1 to k8 output at steps 16 and 17.

The pedal is operated in the same amount for each of the plurality of resonance frequencies/resonance tone pitches. The amount of operation of the pedal, however, differs depending upon the cases. For example, the value of the resonance tone pitch/resonance frequency is divided/operated by the resonance coefficients k1 to k8 output at step 19. Therefore, the operation amount of the pedal increases as the pitch of the tone decreases, and varies depending upon the tone pitch/frequency of the resonance sound. That is, the amount of operation of the pedal for the resonance sound of a low tone pitch is larger than the amount of operation of the pedal for the resonance sound of a high tone pitch. The amount of pedal operation may be increased with an increase in the tone pitch. In this case, the value of the resonance tone pitch/resonance frequency is multiplied/operated upon the resonance coefficients k1 to k8 output at step 19.

The resonance coefficients k1 to k8 for the plurality of resonance tone pitches/resonance frequencies are operated and synthesized with the key number data KN (tone pitch/tone pitch range), frequency number data FN, tone number data TN (timbre), touch data TC, tone time data TM (sounding time) and/or damper pedal data DP. Therefore, the resonance amount for each of the tone pitch changes and is controlled depending upon the timbre, touch, tone pitch, tone pitch range, sounding time and/or the amount of pedal operation. Thus, the resonance amount for each of the resonance tone pitch is varied depending upon the musical factors and/or the amount of pedal operation.

There is no limitation on the number of sounds that are resonated/concurrently sounded by the processing for generating resonance coefficients k1 to k8 at steps 12 to 19. Limitation, however, is imposed depending upon the cases. For example, the resonance sounds are limited to be four from the sound having a low tone pitch. In this case, it is judged whether the number of tones being sounded is smaller than 4 between step 11 and step 12, and it is judged whether the tone pitch of the tone related to the key-on event is lower than the highest tone pitch of the tones sounded thus far. At step 19, further, resonance coefficients k1 to k8 of four resonance tone pitches from the lowest tone pitch are read out from the table 92 of resonance coefficients, and are multiplied by the damper pedal data DP.

When the number of the tones is smaller than 4, the processings are executed at steps 12 to 19. When the tone pitch is low, the resonance coefficients k1 to k8 of the above highest tone pitch only are subtracted, and the processings of steps 12 to 19 are executed. In the plurality of resonance tone pitches/resonance frequencies that are thus realized, the resonance sound having a low tone pitch takes precedence over the resonance sound having a high tone pitch.

When the key event is an off event, one or a plurality of corresponding resonance coefficients k1 to k8 are read out from the table 92 of resonance coefficients based on the key number data KN of the tone related to the key-off event. The resonance coefficients k1 to k8 which are read out are reduced into the resonance coefficients k1 to k8 that had been accumulated at step 16, are stored in the group of latches 91, respectively, and are fed to the multipliers 71 to 78 in the resonator 50. This processing is executed at step 20.

Whether the sostenuto pedal 9 is operated is also judged at step 20. When the damper pedal data DP (which also means data from the sostenuto pedal 9) is not "0" and the sostenuto pedal 9 has not been depressed, the processing related to the key-off event is not executed even when there occurred a key-off event.

In this case, processings of steps 18 and 19 corresponding to the damper pedal data DP (data from the sostenuto pedal 9) are executed, too. Thus, the resonance amount is controlled depending upon the amount of operation of the sostenuto pedal 9. When the sostenuto pedal 9 or the damper pedal 7 are not operated, only those tones during the key-on are detected again, the processings of steps 12 to 17 are repeated, and only those tones during the key-on are resonated.

Thus, when the sostenuto pedal 9 is operated, resonance is added to the tone of a tone pitch that was sounded just before. When the sostenuto pedal 9 is not operated, no resonance is added to the tone of a pitch sounded just before.

8. Table 92 of Resonance Coefficients

FIGS. 7 to 10 illustrate the table 92 of resonance coefficients. The table 92 of resonance coefficients is storing the resonance coefficients k for the key number data KN of an octave of tone pitches C4 to B4. This is to simplify the description, and the resonance coefficients k have similarly been stored even for other octaves. As for other octaves, the resonance coefficients k of FIGS. 7 to 10 are directly used or are calculated in proportion to the tone pitch/frequency number data FN.

In an example of FIG. 7, resonance coefficients k are found in the case of when the tone pitches C4, E4 and G4 are being sounded (during the key on, during the sounding operation, the same holds hereinafter). In an example of FIG. 8, resonance coefficients k are found in the case of when the tone pitches C4, E4 and G4 are being sounded, the damper pedal 7 is depressed to a maximum degree, and the damper pedal data DP is "1.00".

In an example of FIG. 9, resonance coefficients k are found in the case of when the tone pitches C4, E4 and G4 are being sounded, the damper pedal 7 is depressed half (half pedal), and the damper pedal data DP is "0.60". In an example of FIG. 10, resonance coefficients k are found in the case of when the tone pitches A4 and B4 are being sounded and, then, the tone pitches C4, E4 and G4 are sounded.

FIG. 11 illustrates properties/characteristics of the resonance coefficients k. Numerals "1" to "8" on the abscissa correspond to eight stages of delay elements 61 to 68, multipliers 71 to 78 and resonance coefficients k1 to k8 of the resonator 50. The delay times of the delay elements 61 to 68 are equal to the sampling periods for processing the digital signals. When the sampling frequency is presumed to be 2 kHz, therefore, "1" on the abscissa corresponds to a resonance frequency of 2 kHz.

Similarly, numerals "2", "3", "4", "5", "6", "7" and "8" on the abscissa are corresponding to resonance frequencies of 2 kHz/2=1 kHz, 2 kHz/3=666.7 Hz, 2 kHz/4=500 Hz, 2 kHz/5=400 Hz, 2 kHz/6=333.3 Hz, 2 kHz/7=285.7 Hz and 2 kHz/8=250 Hz.

That is, the numerals on the abscissa, positions of the resonance coefficients k1 to k8, and positions of eight delay elements 61 to 68, represent how many sampling points (inclusive of the number of the sampling periods, the same holds hereinafter) are contained in one wavelength (inclusive of one period, the same holds hereinafter) of the tone waveform data MW. Therefore, the delay period/feedback period/the delay and feedback period is in agreement with, is an integer times as great as, or is one divided by an integer of, the sampling period.

For example, when the tone of the tone pitch F4 is being sounded and resonance is added to the tone of the tone pitch F4, the frequency of the tone pitch F4 is 349.23 Hz. Since the sampling frequency is 2 kHz, the number of sampling points per a wavelength of the tone pitch F4 is 2 kHz/349.23 Hz=5.73. However, it is not allowed to feed the resonance coefficient k directly to the place of the stage "5.73".

Therefore, the fifth and sixth resonance coefficients k5 and k6 neighboring each other with "5.73" sandwiched there between are fed to the multipliers 75 and 76. Depending upon the fraction "0.73" of "5.73", the resonance coefficients k5 and k6 are weighted/proportionally distributed by "1−0.73=0.27" and "0.73".

Accordingly, the weighting amounts of the tone waveform data MW that are successively delayed are determined based upon a relationship among the delay period/feedback period of the delay elements 61 to 68, sampling period of the tone waveform data MW that are generated, and a frequency of the tone waveform data MW to which resonance is added, i.e., a period of a tone pitch of a resonance sound having resonance characteristics. The same holds for weighting other tone pitches. The resonance coefficients k are found by the similar weighting based on a relationship between the frequencies of the tone pitches and the sampling frequencies. In other words, the weighting is to more finely interpolate/operate in interpolation/distribute/proportionally distribute/proportionally calculate the delayed outputs or the resonance coefficients k1 to k8 depending upon the resonance frequency/resonance tone pitch that is to be realized. The weightings of the outputs of a plurality of delay elements 61 to 68 are proportionally distributed to the delay elements 61 to 68 corresponding to the resonance frequencies/resonance tone pitches over the delay elements 61 to 68.

The weighting is operated by a predetermined window function by using, as a center or a maximum value, a delay output corresponding to the frequency (number of sampling points per a period) of the tone waveform data MW. The window of the window function has a width equal to two sampling points per a period of a musical tone, and a maximum value of the center becomes "1.00". The window of the window function may have a width equal to three, four or more of the sampling points per a period of the musical tone.

Thus, the weighting becomes the greatest for the delayed output corresponding to the delay period/feedback period that corresponds to the period of the tone waveform data MW to which resonance is added. FIG. 11 illustrates an example of a trigonometric function. The trigonometric window function may be replaced by Hamming window function, Hanning window function, Lease (Liese/Rease/Riese) window function or Blackman-Harris window function.

When the tone pitches C4, E4 and G4 are being sounded in FIG. 7, there are found a resonance coefficient k8=0.64 (C4)×1.00=0.64, a resonance coefficient k7=0.36 (C4)×1.00+0.07 (E4)×1.00=0.43, a resonance coefficient k6=0.93 (E4)×1.00+0.10 (G4)×1.00=1.03, and a resonance coefficient k5=0.90 (G4)×1.00=0.90.

Thus, the tone signals synthesized into one resonate at a plurality of resonance frequencies/resonance tone pitches, and are weighted depending upon the plurality of resonance frequencies/resonance tone pitches. The resonance frequencies/resonance tone pitches are in agreement with the tone pitches of the tone signals constituting the tone signals that are synthesized into one. Depending upon the cases, however, the tone pitches/frequencies that are an integer times as great as the tone pitch frequencies are weighted and resonated. Therefore, the resonance frequencies/resonance tone pitches are corresponding to the tone pitches of tone signals constituting the tone signals that are synthesized into one.

When the damper pedal 7 is depressed to a maximum degree in FIG. 8 and the damper pedal data DP is "1.00", the resonance coefficients k1 to k8 are accumulated/added over the whole tone pitches, and there are found resonance coefficients k8=0.86, k7=2.45, k6=2.93, k5=3.47 and k4=2.29.

When the damper pedal 7 is depressed half (half pedal) in FIG. 9 and the damper pedal data DP is "0.60", the resonance coefficients k of tone pitches being sounded are multiplied by "1.00", and the resonance coefficients k of other tone pitches during the sound off (during the key off, during the sound off, the same holds hereinafter) are multiplied by "0.60". Therefore, there are found resonance coefficients k8=0.77, k7=1.64, k6=2.17, k5=2.44 and k4=1.37.

When the tone pitches A4 and B4 are being sounded and, then, the tone pitches C4, E4 and G4 are sounded in FIG. 10, there are found a resonance coefficient k8=0.64 (C4)×1.00=0.64, a resonance coefficient k7=0.36 (C4)×1.00+0.07 (E4)×1.00=0.43, a resonance coefficient k6=0.93 (E4)×1.00+0.10 (G4)×1.00=1.03, a resonance coefficient k5=0.90 (G4)×1.00+0.55 (A4)×1.00+0.05 (B4)×1.00=1.50 and a resonance coefficient k4=0.45 (A4)×1.00+0.95 (B4)×1.00=1.40. Thus, the tone signals synthesized into one are sounded at a plurality of resonance frequencies/resonance tone pitches, and are weighted depending upon the plurality of resonance frequencies/resonance tone pitches.

Thus, the damper pedal data DP become all "1.00" at any time during the sounding, irrespective of when the sounding operation (key on) is effected, or when the tone is sounded. Accordingly, the resonance is realized like that of a real piano. The damper pedal data DP of a tone being sounded becomes "1.00" even when the damper pedal 7 is not operated. Therefore, the damper pedal data DP also has the meaning of "resonance balance data".

As described above, the weighting is so effected that resonance occurs for the whole musical tones when the damper pedal 7 (operation button) is operated, and that resonance occurs for those tones only that are being sounded when the damper pedal 7 (operation button) is not operated.

9. Processing for Calculating the Resonance Coefficients k

Figure 12:
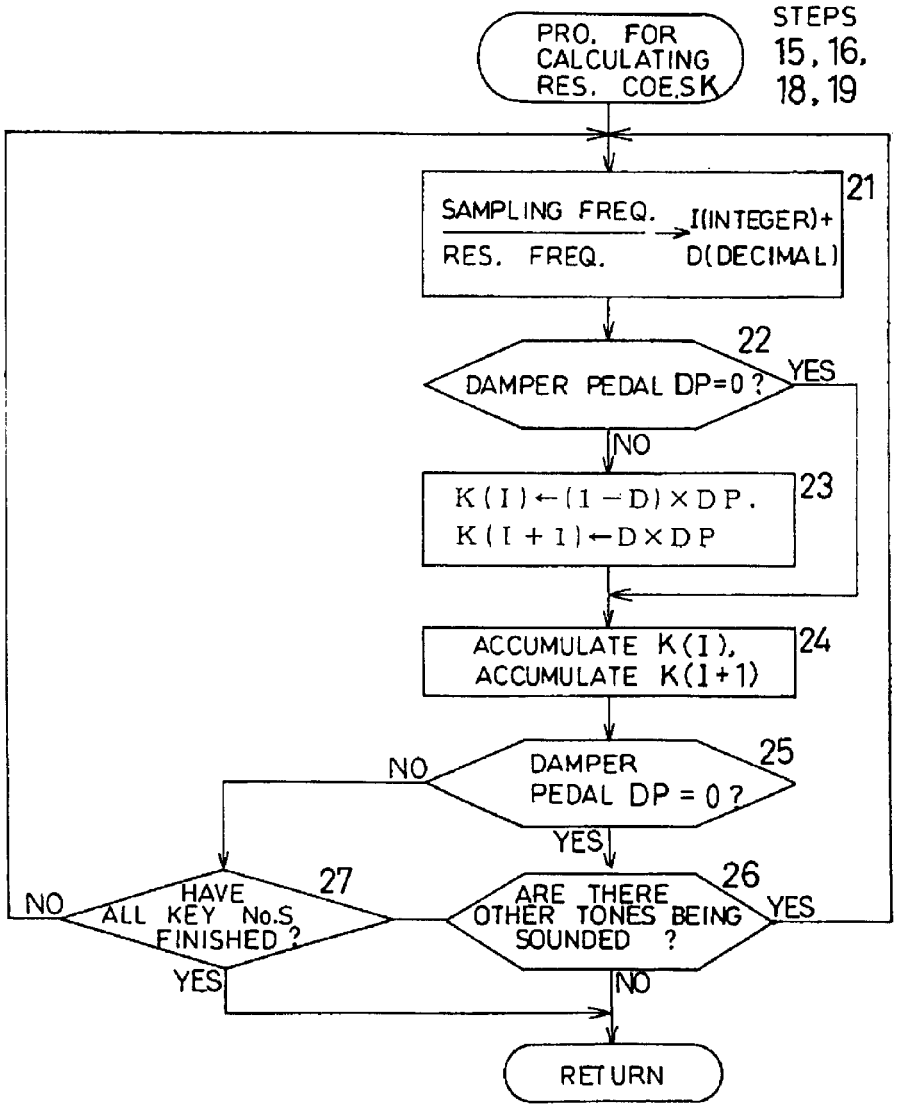
FIG. 12 is a diagram of a flowchart of a processing for calculating the resonance coefficients k.

FIG. 12 is a diagram of a flowchart of a processing for calculating the resonance coefficients k. The controller 2 executes a program for this flowchart. The processing of FIG. 12 is executed being substituted for the processings of steps 15, 18, 19 and 16 in FIG. 6.

First, the frequency or the frequency number data FN of the tone being sounded is divided by the sampling frequency of the tone waveform data MW or by the frequency number data FN corresponding to the sampling frequency (step 21). The sampling frequency or the frequency number data FN corresponding to the sampling frequency has a fixed value, and has been stored in advance in the program/data storage unit 3.

As for the frequency number data FN of a tone being sounded, the frequency number data FN of which the on/off data is "1" are read out among various tone data from the assignment memory 40. The value of frequency of the tone being sounded is calculated from the frequency number data FN during the sounding.

An integer portion of the divided value is expressed as "I" and the decimal portion is expressed as "D" (step 21). When the damper pedal data DP is not "0" (step 22), the decimal portion "D" and "1−D" obtained by subtracting the decimal portion D from "1" are multiplied by the damper pedal data DP (step 23). The multiplied result is accumulated/integrated on the resonance coefficient k(I) and on the resonance coefficient (I+1) that is higher by 1 (step 24). Based upon the integer portion "I", the number of the resonance coefficients k1 to k8 is determined, and any one of the resonance coefficients k1 to k8 is selected.

When the damper pedal data DP is "0" (step 22), the processing of step 23 is omitted. The processing for operating/calculating the resonance coefficients k is repeated for all other tones being sounded when the damper pedal data DP is "0" (step 25), and the resonance coefficients k(I)/k(I+1) being found are successively accumulated/integrated (step 26).

The processing for operating/calculating the resonance coefficients k is repeated for the tones of all other tone pitches when the damper pedal data DP is not "0" (step 25), and the resonance coefficients k(I)/k(I+1) being found are successively accumulated/integrated (step 27). Accordingly, the tone signals synthesized into one are resonated at a plurality of resonance frequencies/resonance tone pitches, and are weighted depending upon the plurality of resonance frequencies/resonance tone pitches. Upon executing the processing for operating/calculating the resonance coefficients k as described above, the table 92 of resonance coefficients can be omitted.

The resonance coefficients k can similarly be found even for other octaves. In this case, the frequency number data FN of the tones to be resonated can be selected over the whole octave by the processing of step 21. The resonance coefficients k of other octaves found by the processing of step 21 are also stored in the table 92 of resonance coefficients. The number of the resonance coefficients k increases correspondingly, accompanied by an increase in the numbers of the delay elements 61 to 68, multipliers 71 to 78 and adders 81 to 87 in the resonator 50.

At steps 21 and 26, the sounding processing is effected for the tones being sounded despite the tones may have different octaves (tone pitch ranges) though their names are the same. Therefore, even the tones for which the sounding operation has not been effected are resonated and output when they are an integer times as great as/one divided by an integer of, the frequencies/periods/tone pitches of the tones being sounded. Therefore, the window function or the weighting is formed/effected for each octave to effect the synthesis for all octaves.

At steps 21 and 26, further, the resonance processing is effected for the tones that are being sounded when they have a high degree of resonance correlation. The resonance correlation is high when there is a relation of frequency ratio of 1:n (n=1, 2, 3, 4, 5, 6, - - - ), and gradually increases when there is a relation of frequency ratio of 2:3n (n=1, 2, 3, - - -) (perfect fifth, etc.), 3:4n (n=1, 2, 3, - - - ) (perfect fourth, etc.), 3:5n (n=1, 2, 3, - - - ) (major sixth, etc.), 4:5n (n=1, 2, 3, - - - ) (major third, etc.), 5:6n (n=1, 2, 3, - - - ) (minor third, etc.), - - - . As for the relation of frequency ratio of 1:n (n=1, 2, 3, 4, 5, 6, - - - ), however, the value of resonance correlation decreases as the value "n" increases.

Further, the resonance coefficients k1 to k8 read out from the table 92 of resonance coefficients or the resonance coefficients k(I) and k(I+1) found at steps 21 to 24 may be multiplied/operated/synthesized by a correction coefficient. The correction coefficient is converted from the key number data KN (tone pitch/tone pitch range), frequency number data FN, tone number data TN (timbre), touch data TC, tone time data TM (sounding time) and/or damper pedal data DP. Therefore, the resonance coefficient k, weighting for resonance or the window function, undergo a change depending upon the timbre of the tone signal, touch, tone pitch, tone pitch range, sounding time and/or the amount of pedal operation.

The window of the window function has a width equal to two sampling points per a period of the tone. The width, however, may be broader. In this case, the width of the window function of FIG. 11 is broadened into 2 times, 3, times, 4 times, - - - to become equal to 3, 4 or 5 sampling points. In response thereto, the values of the resonance coefficients k1 to k8 are proportionally calculated and are output. As the width of the window function is broadened, further, the resonance coefficients k1 to k8 are newly calculated/operated.

10. Filter Coefficient Generator 98

Figure 13:
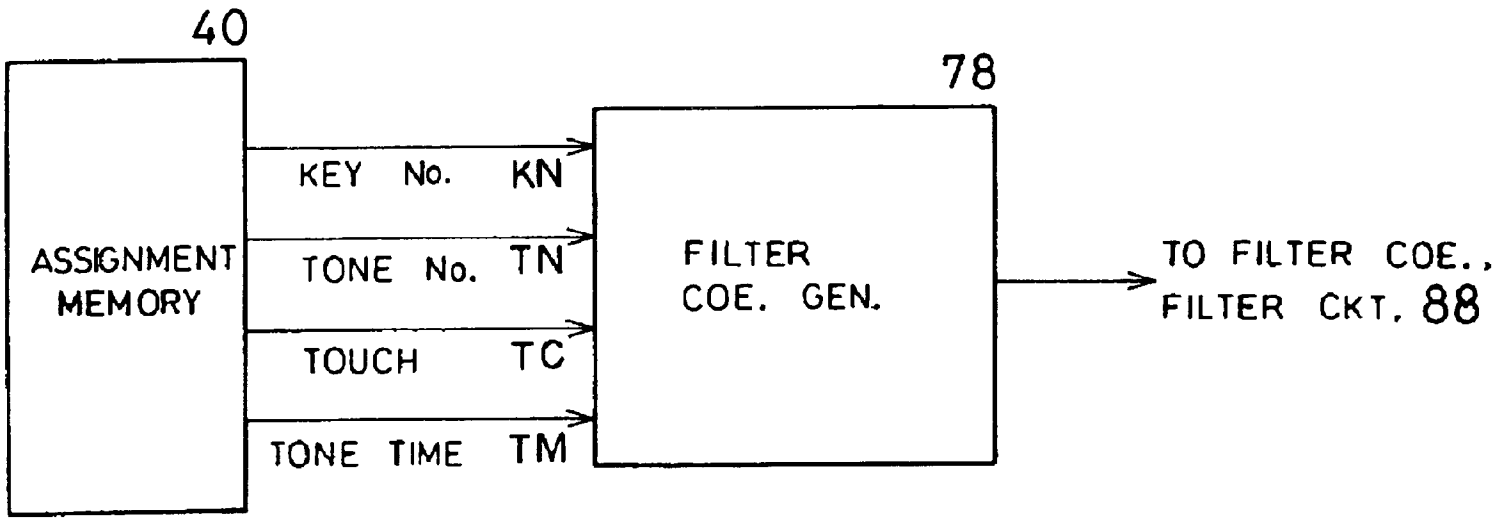
FIG. 13 is a diagram illustrating a filter coefficient generator 98.

FIG. 13 illustrates a filter coefficient generator 98. The filter coefficients generated by the filter coefficient generator 98 are sent to the filter circuit 88 in the resonator 50. The filter circuit 88 is a digital filter of the IIR type or the FIR type, and is constituted by delay elements, multipliers and adders (accumulators). The filter coefficients are fed to the multipliers.

The filter coefficient generator 98 includes a table/memory such as ROM/RAM from which corresponding filter coefficients are read out based upon the key number data KN (tone pitch/tone pitch range), frequency number data FN, tone number data TN (timbre), touch data TC and/or tone time data TM (sounding time) and/or damper pedal data DP. The key number data KN (tone pitch/tone pitch range), frequency number data FN, tone number data TN (timbre), touch data TC, tone time data TM (sounding time) and/or damper pedal data DP are fed from the assignment memory 40 for each of the channels in a time-division manner.

Therefore, the filter characteristics of the resonator 50 undergo a change depending upon the timbre, touch, tone pitch, tone pitch range, sounding time and/or the amount of pedal operation. The filtering operation is executed for every series of successive delays fed back and repeated by the resonator 50. The filtering operation undergoes a change depending upon the timbre of the tone waveform data MW, touch, tone pitch, tone pitch range, sounding time and/or the amount of pedal operation.

Depending upon the cases, a multiplier is added to the filter circuit 88. The multiplier multiplies a coefficient that is usually smaller than "1/N". "N" of the coefficient "1/N" corresponds to the number of the delay elements 61 to 68. Therefore, the resonator 50 is prevented from oscillating.

The value of the coefficient multiplied by the multiplier of the filter circuit 88 is smaller than an inverse number of a resultant value of the resonance coefficients k1 to k8. Therefore, the feedback amount is prevented from oscillating in the resonator 50. In this case, despite the magnitude of resonance amount successively changes accompanying changes in the resonance coefficients k1 to k8, the sound volume of the tone output from the adder 60 does not much change but lies within a predetermined range, necessarily preventing the oscillation in the resonator 50. As a result, the feedback amount of the multiplier of the filter circuit 88 is corrected by a value of inverse characteristics of a resultant value of weighting to prevent the oscillation.

The multiplier of the filter circuit 88 multiplies other coefficients which are read out from the memory based upon the key number data KN (tone pitch/tone pitch range), frequency number data FN, tone number data TN (timbre), touch data TC, tone time data TM (sounding time) and/or damper pedal data DP, or which are operated from these data. Therefore, the feedback amount of the resonator 50 is changed and controlled by the timbre, touch, tone pitch, tone pitch range, sounding time and/or the amount of pedal operation. As a result, the magnitude of resonance sound/resonance amount/feedback amount are changed and controlled by the timbre, touch, tone pitch, tone pitch range, sounding time and/or the amount of pedal operation.

11. Overall Processing

Figure 14:
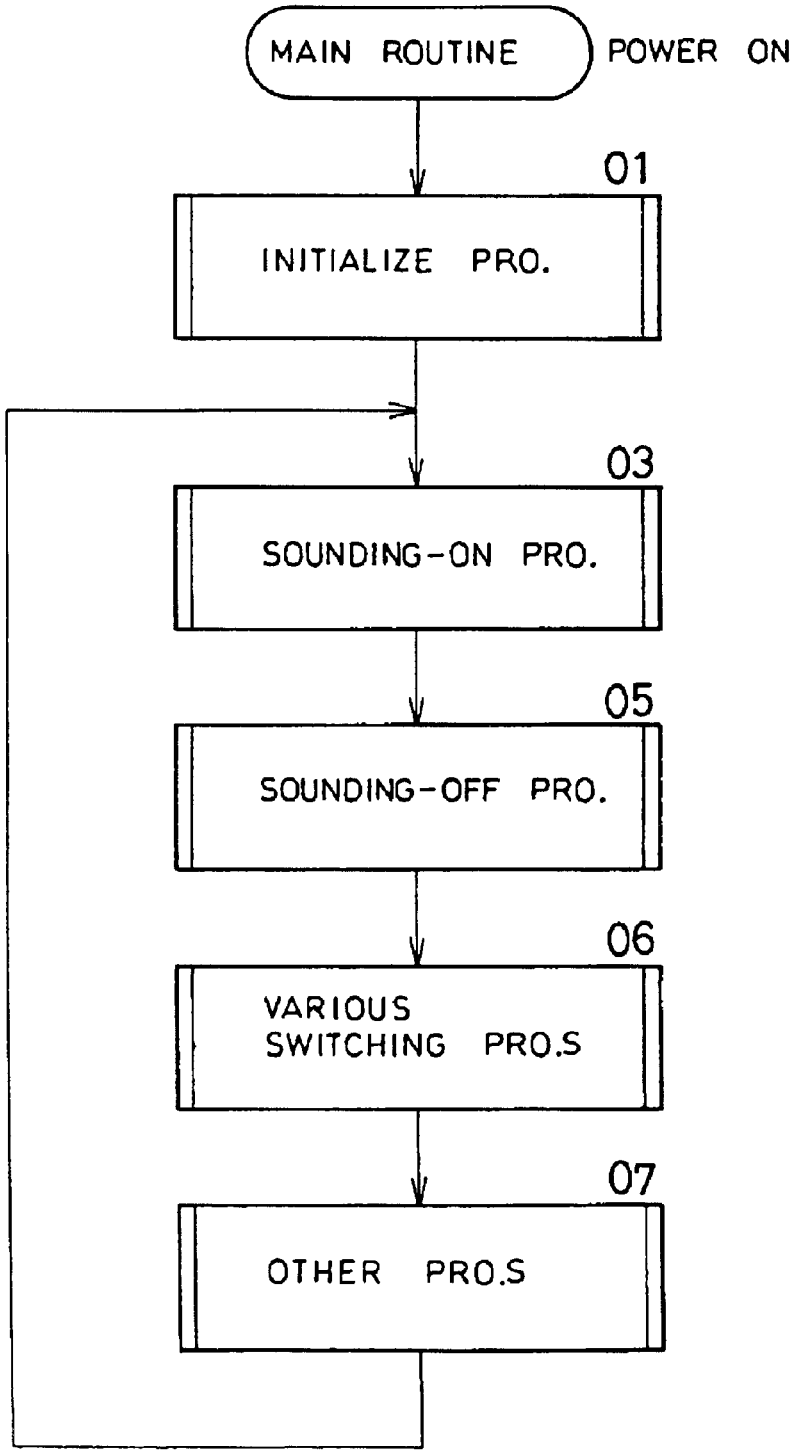
FIG. 14 is a diagram of a flowchart illustrating the whole processing.

FIG. 14 is a diagram of a flowchart of the overall processing executed by the controller (CPU) 2. The overall processing starts as the power source of the tone generating apparatus is turned on, and is repetitively executed until the power source is turned off. First, a variety of initialize processings such as initializing the program/data storage unit 3, etc. are executed (step 01), and the sounding-on processing is executed in the performance information generated unit 1 based on the manual play or the automatic play (step 03).

In the sounding-on processing, vacant channels are searched, and musical tones related to the on-event are assigned to the vacant channels that are searched. Contents of the musical tones are determined by performance information (tone generating data) from the performance information generated unit 1, musical factor data of tone control data, and musical factor data that have been stored already in the program/data storage unit 3.

In this case, on/off data of "1", frequency number data FN, envelope speed data ES, envelope time data EL, and envelope phase data EF of "0" are written into the areas of the assignment memory 40 of vacant channels that are searched. There are further written tone number data TN, touch data TC, part number data PN and tone time data TM of "0".

Then, the sounding-off (attenuation) processing is effected in the performance information generated unit 1 based upon the manual play or the automatic play (step 05). In the sounding-off (attenuation) processing, channels to which are assigned the tones related to the off event (key-off event, sounding-off event) are searched to attenuate and sound off the tones. In this case, the on/off data of "1" is rewritten into "0", envelope phases of the tones related to the key-off event are released, and the envelope levels gradually approach "0".

When various switches of the performance information generated unit 1 are operated, musical factor data corresponding to the switches are taken in, and are stored in the program/data storage unit 3 to change the musical factor data (step 06). Thereafter, other processings are executed (step 07), and the processings are repeated from step 02 through up to step 07.

12. Processing of the Tone Time Data TM and the Number of Concurrent Soundings

Figure 15:
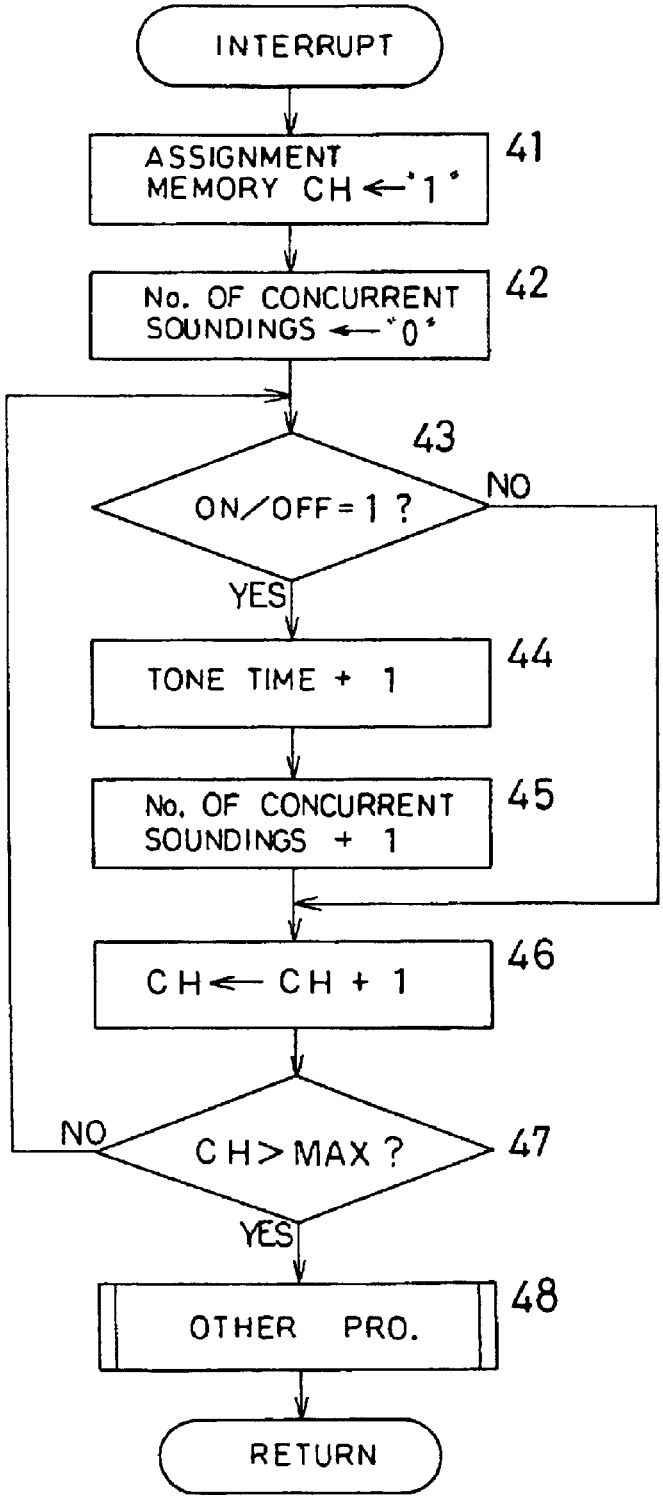
FIG. 15 is a diagram of a flowchart of an interrupt processing executed after every predetermined period.

FIG. 15 is a diagram of a flowchart illustrating an interrupt processing executed by the controller (CPU) 2 at regular time intervals. This processing counts the increment of the tone time data TM and the number of concurrent soundings. In this processing, the tone time data TM is increased by "+1" (step 44) for the tones which are being sounded with the on/off data being "1" (step 43) in the channel areas of the assignment memory 40 (steps 41, 46 and 47).

In the channel areas of the assignment memory 40 (steps 41, 46 and 47), further, the data related to the number of concurrent soundings is once cleared (step 42), the tones that are being sounded with the one/off data being "1" are counted (step 43), and the number of concurrent soundings is increased by "+1" successively (step 45). The counted number of the concurrent soundings is stored in the program/data storage unit 3.

Other periodical processings are then executed (step 48). Thus, sounding elapse times of tones of the channels are counted, stored and are utilized as the sounding time data. Further, the number of tones being sounded of all channels are counted and stored at every moment, and are used as the concurrently sounding number data.

The present invention is not limited to the above-mentioned embodiment only but can be modified in a variety of ways without departing from the spirit and scope of the invention. For example, reverberation may be added to the outputs from the resonator 50. The reverberation that is added consists of an early reflection and a lately reverberation sound. A reverberation adder circuit includes delay elements for receiving feedback, multipliers and adders (accumulators), and is constituted in the same manner as the resonator 50 of FIG. 4. However, the delay times of the delay elements are set to be several times to several tens of times to several hundreds of times of the periods of the tones that are delayed.

The musical tone signals that are accumulated and synthesized by the accumulator 45 are those for the number of all channels. There may be provided a plurality of accumulators 45 and a plurality of resonators 50, and the two or more musical tone signals may be synthesized by each accumulator 45, and resonance may be added to each of the synthesized tone signals through each resonator 50.

The present invention includes the computer program itself, and method and apparatus for communicating the computer program.

What is claimed is:

1. A resonance apparatus comprising:

first means for generating a plurality of musical tone signals at a predetermined sampling period and synthesizing these signals into one;

second means for successively delaying the synthesized musical tone signals, weighting, synthesizing and outputting the musical tone signals that are successively delayed, feeding back the delayed, weighted, synthesized and outputted musical tone signals, repeating a series of successive above delays, weights, synthesizes and outputs by the feedback and thus imparting resonance characteristics;

third means for determining the amount of weighting the musical tone signals successively delayed based upon a relationship among a delay feedback period, the period of sampling the generated musical tone signals and a tone pitch period of the resonance sound imparted with resonance characteristics, and determining whereby a frequency of the resonance characteristics;

fourth means for interpolating/distributing the delayed outputs depending upon the resonance frequency/resonance tone pitch that is to be realized based upon the weighting.

2. A resonance apparatus comprising:

first means for generating a plurality of musical tone signals at a predetermined sampling period and synthesizing these signals into one;

second means for successively delaying the synthesized musical tone signals, weighting, synthesizing and outputting the musical tone signals that are successively delayed, feeding back the delayed, weighted, synthesized and outputted musical tone signals, repeating a series of successive above delays, weights, synthesizes and outputs by the feedback and thus imparting resonance characteristics;

third means for determining the amount of weighting the musical tone signals successively delayed based upon a relationship among a delay feedback period, the period of sampling the generated musical tone signals and a tone pitch period of the resonance sound imparted with resonance characteristics, and determining whereby a frequency of the resonance characteristics;

fourth means for distributing the weightings of the outputs of a plurality of delay means to the delay means corresponding to the resonance frequency/resonance tone pitches over the delay means.

3. A resonance apparatus comprising:

first means for generating a plurality of musical tone signals at a predetermined sampling period and synthesizing these signals into one;

second means for successively delaying the synthesized musical tone signals, weighting, synthesizing and outputting the musical tone signals that are successively delayed, feeding back the delayed, weighted, synthesized and outputted musical tone signals, repeating a series of successive above delays, weights, synthesizes and outputs by the feedback and thus imparting resonance characteristics;

third means for determining the amount of weighting the musical tone signals successively delayed based upon a relationship among a delay feedback period, the period of sampling the generated musical tone signals and a tone pitch period of the resonance sound imparted with resonance characteristics, and determining whereby a frequency of the resonance characteristics;

fourth means for resonating the tone signals synthesized into one at a plurality of the resonance frequencies/resonance tone pitched, finding the weighting of each of the resonance frequencies/resonance tone pitches, adding/operating/synthesizing each of the weightings for the each of the resonance frequencies/resonance tone pitches, and effecting the weightings corresponding to a plurality of the resonance tone pitches/resonance frequencies.

4. The resonance apparatus according to the claim 1, 2 or 3, wherein the tone signals that are successively delayed are weighted for outputs of neighboring two, three, four or more delay means.

5. The resonance apparatus according to claim 1, 2 or 3, wherein the amount of resonance/the amount of an operation of a pedal for a plurality of the resonance tone pitches/resonance frequencies are the same or different from each other, or vary depending upon the tone pitches/frequencies of the resonance sounds, the amount of resonance is larger for a lower tone pitch or for a higher tone pitch, and the resonance amount for each of the resonance tone pitches/resonance frequencies is varied depending upon the musical factors/the amount of the pedal operation.

6. The resonance apparatus according to claim 1, 2 or 3, wherein the weighting of each of tone signals that is successively delayed is operated by a predetermined window function by using a delay output, as a center or a maximum value, corresponding to the frequency of the tone signals.

7. The resonance apparatus according to claim 6, wherein the window function or the weighting is formed for each octave to effect the synthesis for all octaves.

8. The resonance apparatus according to claim 6, wherein the window of the window function has a width equal to two, three or more sampling points per period of the tone.

9. The resonance apparatus according to claim 1, 2 or 3, wherein the series of successive delays and the feedback amount in the resonance are controlled, therefore a magnitude of the resonance sound is controlled and a resonance amount is controlled.

10. The resonance apparatus according to claim 1, 2, or 3, wherein the feedback amount is corrected by a value of inverse characteristics of a resultant value of the weightings to preserve the oscillation.

11. The resonance apparatus according to claim 1, 2 or 3, wherein a filtering operation is executed for every series of successive delays and feedback that are repeated, and the filtering operation and the amount of feedback undergo a change depending upon a timbre, a touch, a tone pitch, a tone pitch range, a sounding time and/or a amount of pedal operation.

12. The resonance apparatus according to claim 1, 2 or 3, wherein in the plurality of resonance tone pitches/resonance frequencies which are realized, the resonance sound having a low tone pitch takes precedence over the resonance sound having a high tone pitch, and a magnitude of the resonance sound of a low tone pitch is larger than a magnitude of the resonance sound of a high tone pitch.

13. The resonance apparatus according to claim 1, 2 or 3, wherein the weighting is so effected that resonance occurs for whole musical tones when a damper pedal or an operation button is operated, and that resonance occurs for those tones only that are being sounded when the damper pedal or the operation button is not operated, and a resonance amount is controlled depending upon the operation amount of the damper pedal or the operation button.

14. The resonance apparatus according to claim 1, 2 or 3, wherein when a sostenuto pedal or an operation button is operated, resonance is added to a tone which was sounded just before and when the sostenuto pedal or the operation button is not operated, no resonance is added to the tone which was sounded just before, and a resonance amount is controlled depending upon an amount of operation of the sostenuto pedal or the operation button.

15. The resonance apparatus according to claim 1, 2 or 3, wherein the delay and feedback period is in agreement with, is an integer times as great as, or is one divided by an integer of, the sampling period.

16. The resonance apparatus according to claim 1, 2 or 3, wherein the weighting becomes the greatest for the delayed output corresponding to the delay and feedback period that corresponds to a period of the tone signal to which resonance is added.

17. The resonance apparatus according to claim 1, 2 or 3, wherein a number of stages of the successive delay corresponds to, is in agreement with, is an integer number of times as great as, or is one divided by an integer of, an octave number of the tones generated by the resonance apparatus.

18. A resonance method comprising:

generating a plurality of musical tone signals at a predetermined sampling period and synthesizing these signals into one;

successively delaying the synthesized musical tone signals, weighting, synthesizing and outputting the musical tone signals that are successively delayed, feeding back the delayed, weighted, synthesized and outputted musical tone signals, repeating a series of successive above delays, weights, synthesizes and outputs by the feedback and thus imparting resonance characteristics;

determining the amount of weighting the musical tone signals successively delayed based upon a relationship among a delay feedback period, the period of sampling the generated musical tone signals and a tone pitch period of the resonance sound imparted with resonance characteristics, and whereby determining a frequency of the resonance characteristics;

interpolating/distributing the delayed outputs depending upon the resonance frequency/resonance tone pitch that is to be realized based upon the weighting.

19. Computer programs stored on a computer readable storage medium containing instructions for instructing the processor to perform a method for resonance processing, comprising:

processing for generating a plurality of musical tone signals at a predetermined sampling period and synthesizing these signals into one;

processing for successively delaying the synthesized musical tone signals, weighting, synthesizing and outputting the musical tone signals that are successively delayed, feeding back the delayed, weighted, synthesized and outputted musical tone signals, repeating a series of successive above delays, weights, synthesizes and outputs by the feedback and thus imparting resonance characteristics;

processing for determining the amount of weighting the musical tone signals successively delayed based upon a relationship among a delay feedback period, the period of sampling the generated musical tone signals and a tone pitch period of the resonance sound imparted with resonance characteristics, and whereby determining a frequency of the resonance characteristics;

processing for interpolating/distributing the delayed outputs depending upon the resonance frequency/resonance tone pitch that is to be realized based upon the weighting.

20. A resonance method comprising:

generating a plurality of musical tone signals at a predetermined sampling period and synthesizing these signals into one;

successively delaying the synthesized musical tone signals, weighting, synthesizing and outputting the musical tone signals that are successively delayed, feeding back the delayed, weighted, synthesized and outputted musical tone signals, repeating a series of successive above delays, weights, synthesizes and outputs by the feedback and thus imparting resonance characteristics;

determining the amount of weighting the musical tone signals successively delayed based upon a relationship among a delay feedback period, the period of sampling the generated musical tone signals and a tone pitch period of the resonance sound imparted with resonance characteristics, and whereby determining a frequency of the resonance characteristics;

distributing the weightings of the outputs of a plurality of delay means to the delay means corresponding to the resonance frequency/resonance tone pitches over the delay means.

21. Computer programs stored on a computer readable storage medium containing instructions for instructing the processor to perform a method for resonance processing, comprising:

processing for generating a plurality of musical tone signals at a predetermined sampling period and synthesizing these signals into one;

processing for successively delaying the synthesized musical tone signals, weighting, synthesizing and outputting the musical tone signals that are successively delayed, feeding back the delayed, weighted, synthesized and outputted musical tone signals, repeating a series of successive above delays, weights, synthesizes and outputs by the feedback and thus imparting resonance characteristics;

processing for determining the amount of weighting the musical tone signals successively delayed based upon a relationship among a delay feedback period, the period of sampling the generated musical tone signals and a tone pitch period of the resonance sound imparted with resonance characteristics, and whereby determining a frequency of the resonance characteristics;

processing for distributing the weightings of the outputs of a plurality of delay means to the delay means corresponding to the resonance frequency/resonance tone pitches over the delay means.

22. A resonance method comprising:

generating a plurality of musical tone signals at a predetermined sampling period and synthesizing these signals into one;

successively delaying the synthesized musical tone signals, weighting, synthesizing and outputting the musical tone signals that are successively delayed, feeding back the delayed, weighted, synthesized and outputted musical tone signals, repeating a series of successive above delays, weights, synthesizes and outputs by the feedback and thus imparting resonance characteristics;

determining the amount of weighting the musical tone signals successively delayed based upon a relationship among a delay feedback period, the period of sampling the generated musical tone signals and a tone pitch period of the resonance sound imparted with resonance characteristics, and whereby determining a frequency of the resonance characteristics;

resonating the tone signals synthesized into one at a plurality of the resonance frequencies/resonance tone pitched, finding the weighting of each of the resonance frequencies/resonance tone pitches, adding/operating/synthesizing each of the weightings for the each of the resonance frequencies/resonance tone pitches, and effecting the weightings corresponding to a plurality of the resonance tone pitches/resonance frequencies.

23. Computer programs stored on a computer readable storage medium containing instructions for instructing a processor to perform a method for resonance processing, comprising:

processing for generating a plurality of musical tone signals at a predetermined sampling period and synthesizing these signals into one;

processing for successively delaying the synthesized musical tone signals, weighting, synthesizing and outputting the musical tone signals that are successively delayed, feeding back the delayed, weighted, synthesized and outputted musical tone signals, repeating a series of successive above delays, weights, synthesizes and outputs by the feedback and thus imparting resonance characteristics;

processing for determining the amount of weighting the musical tone signals successively delayed based upon a relationship among a delay feedback period, the period of sampling the generated musical tone signals and a tone pitch period of the resonance sound imparted with resonance characteristics, and whereby determining a frequency of the resonance characteristics;

processing for resonating the tone signals synthesized into one at a plurality of the resonance frequencies/resonance tone pitched, finding the weighting of each of the resonance frequencies/resonance tone pitches, adding/operating/synthesizing each of the weightings for the each of the resonance frequencies/resonance tone pitches, and effecting the weightings corresponding to a plurality of the resonance tone pitches/resonance frequencies.

* * * * *